US011491413B2

(12) United States Patent
Anderson

(10) Patent No.: US 11,491,413 B2
(45) **Date of Patent: *Nov. 8, 2022**

(54) ROTATIONALLY ENGAGED TOY BRICK SYSTEM

(71) Applicant: Paul Anderson, San Diego, CA (US)

(72) Inventor: Paul Anderson, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/774,463

(22) Filed: Jan. 28, 2020

(65) Prior Publication Data

US 2020/0164281 A1 May 28, 2020

Related U.S. Application Data

(63) Continuation-in-part of application No. 16/075,868, filed as application No. PCT/US2018/045049 on Aug. 2, 2018, now Pat. No. 10,874,954.

(60) Provisional application No. 62/540,463, filed on Aug. 2, 2017.

(51) Int. Cl.
*A63H 33/06* (2006.01)
*A63H 33/08* (2006.01)

(52) U.S. Cl.
CPC ..... *A63H 33/067* (2013.01); *A63H 33/086* (2013.01)

(58) Field of Classification Search
CPC ..... A63H 33/067; A63H 33/086
USPC ..... D21/503–505
See application file for complete search history.

(56) References Cited

U.S. PATENT DOCUMENTS 2,751,634 A * 6/1956 Washington ..... A63H 33/107 446/487
2,910,737 A * 11/1959 MacMillan ..... A63H 33/107 52/81.1
3,034,254 A * 5/1962 Christiansen ..... A63H 33/086 446/128
3,102,367 A * 9/1963 Pedersen ..... E04B 2/08 52/592.2
4,184,285 A * 1/1980 Arnau Pibet ..... A63H 23/005 446/93
4,375,139 A * 3/1983 Chatani ..... A63H 17/26 446/471
4,606,732 A * 8/1986 Lyman ..... A63H 33/086 446/104

(Continued)

FOREIGN PATENT DOCUMENTS

GB 2288551 A * 10/1995 ..... A63H 33/042
WO WO-2011115569 A1 * 9/2011 ..... A63H 33/107
WO WO-2012033468 A1 * 3/2012 ..... A63H 33/105

*Primary Examiner* — Laura Davison
(74) *Attorney, Agent, or Firm* — Donn K. Harms

(57) ABSTRACT

A toy brick system is provided having a plurality of bricks each of which has a post extending from first end of a body of the brick and having a socket at a second end. The post in each brick in the plurality is engageable with a socket of an adjacently place brick in a removable rotational engagement enabling curved and angled configuration of assembled structures. Engagement and disengagement from the rotational engagement can only occur at a specific engagement angle between adjacent bricks thereby maintaining the rotational engagement of adjacent bricks once engaged and rotated out of the engagement angle. The bricks are configurable in a linear fashion or with curved exterior walls for forming curved structures.

10 Claims, 19 Drawing Sheets

(56) References Cited

U.S. PATENT DOCUMENTS

| | | | | | |
|---|---|---|---|---|---|
| 4,826,464 | A | * | 5/1989 | Bertrand | A63H 33/042 446/120 |
| 5,172,534 | A | * | 12/1992 | Milner | A63H 33/042 446/104 |
| 5,209,693 | A | * | 5/1993 | Lyman | A63H 33/042 403/157 |
| 5,503,497 | A | * | 4/1996 | Dudley | A63H 33/042 403/103 |
| 5,645,463 | A | * | 7/1997 | Olsen | A63H 33/04 446/104 |
| D394,469 | S | * | 5/1998 | Nielsen | D21/500 |
| 5,782,667 | A | * | 7/1998 | Luby | A63F 9/12 446/117 |
| D588,210 | S | * | 3/2009 | Croston | D21/503 |
| D588,211 | S | * | 3/2009 | Croston | D21/503 |
| D672,404 | S | * | 12/2012 | Dawes | D21/503 |
| D758,500 | S | * | 6/2016 | Sorensen | D21/495 |
| 10,307,685 | B2 | * | 6/2019 | Sorensen | A63H 17/262 |
| 10,378,567 | B2 | * | 8/2019 | Acerra | A63H 33/086 |
| 2015/0224416 | A1 | * | 8/2015 | Schildknecht | A63H 33/042 446/104 |

* cited by examiner 10
14
14
14
14
68
68
68
68
68
12
12
12
12
12
16
16
16
16
20
22
34

38
22
30
34
31
29
44
12
28

38
22
48
28
70
48
31

38
22
28
68
12
12

38
22
29
28
31
12

22
38
28
70
48
X
48
49
34
E
12
40

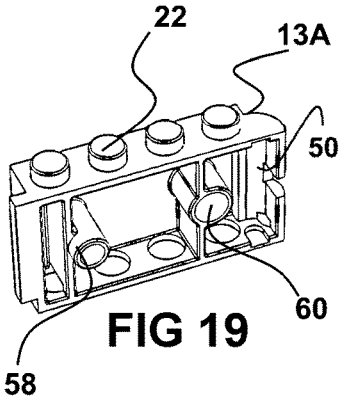
FIG 19
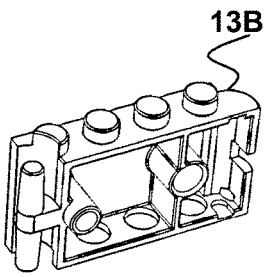
FIG 20
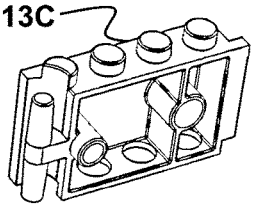
FIG 21
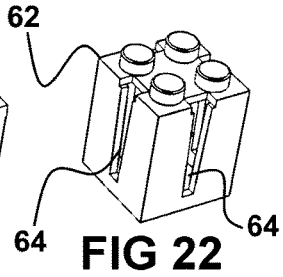
FIG 22
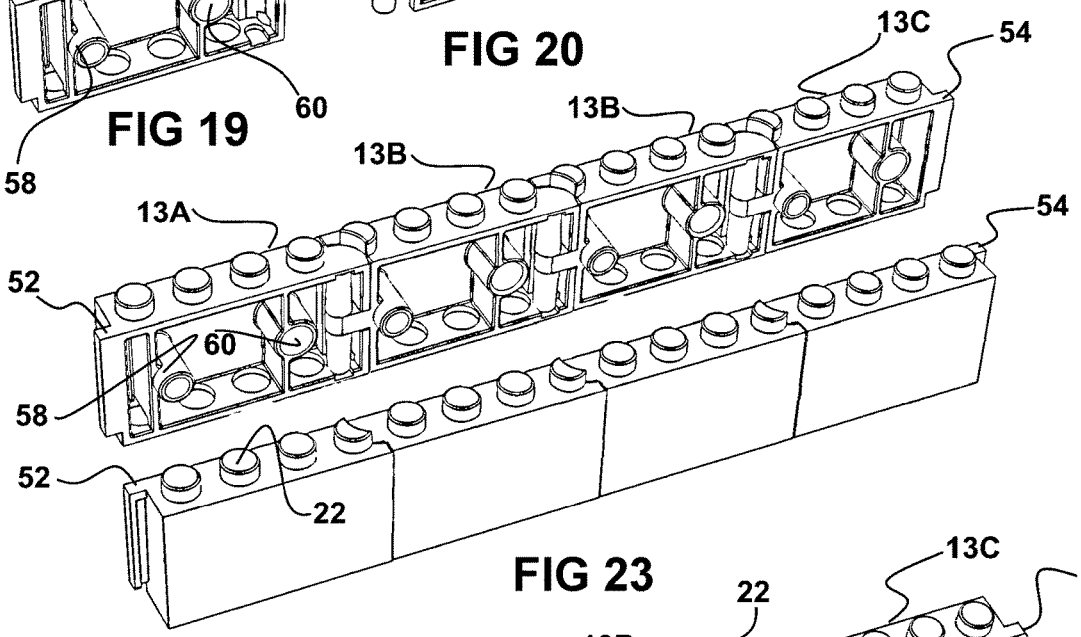
FIG 23
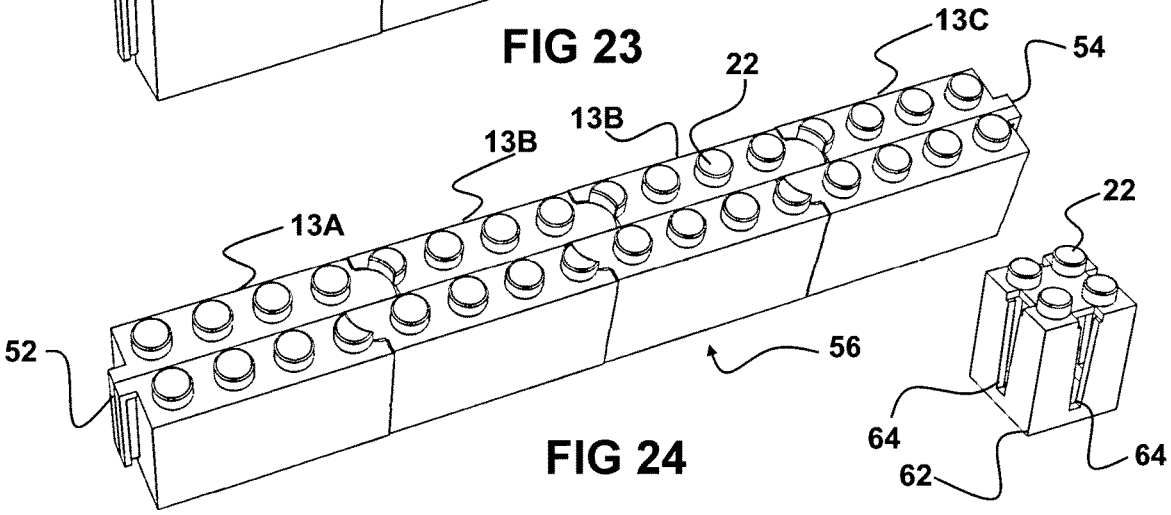
FIG 24
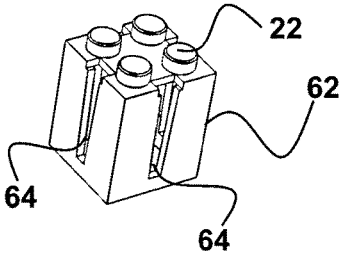

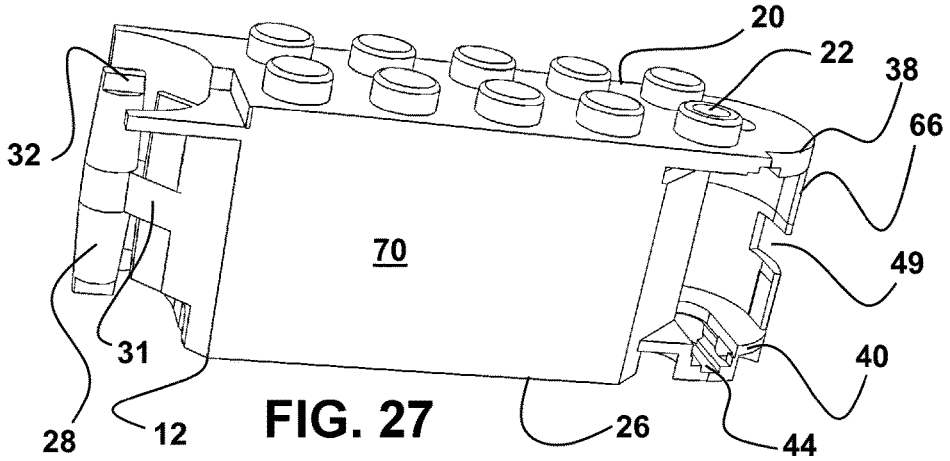
FIG. 27
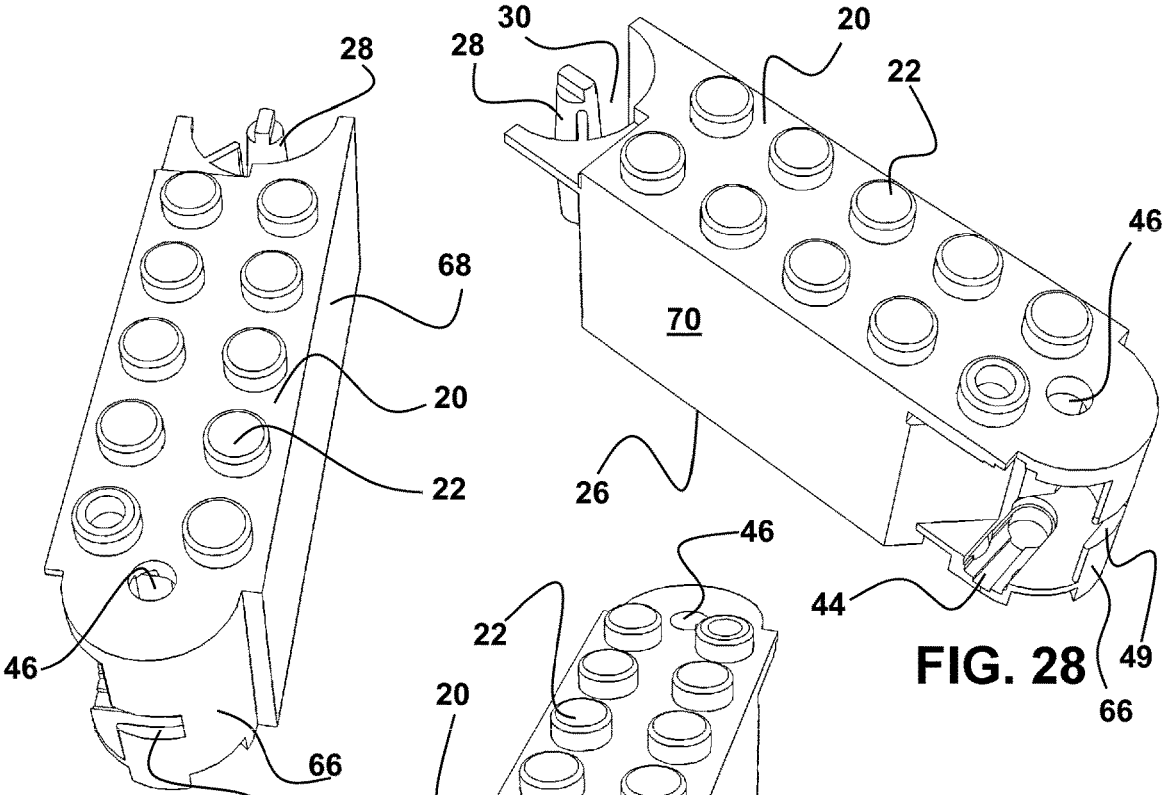
FIG. 28
FIG. 29
FIG. 30

ROTATIONALLY ENGAGED TOY BRICK SYSTEM

This application is a Continuation-in-Part application to U.S. patent application Ser. No. 16/075,868 filed on Aug. 6, 2018, which is a U.S. National Phase Application based on International Application Number PCT/US18/45049 filed on Aug. 2, 2018 which claims the benefit of U.S. Provisional Patent Application Ser. No. 62/540,463 filed on Aug. 2, 2017, both of which being incorporated herein in their entirety by this reference thereto.

FIELD OF THE INVENTION

The present device relates to a toy-building block system. More particularly, the device and method herein relate to a toy building block configured with convex and concave ends of adjacent toy building blocks, which so engaged, results in a pivoting block engagement which yields rotation and a substantially gapless sidewall.

BACKGROUND OF THE INVENTION

Toy bricks for building structures have been enjoyed by children and adults alike. Brick systems such as those by LEGO provide brick pieces in a wide variety of sizes, shapes, and colors, which are adapted on two or more side surfaces, to removably engage with corresponding mating surfaces of adjacent brick pieces. Using such removably engageable brick systems, users build many differing types of structures which are limited in type and scope only by the imagination of the builder.

Conventionally, such brick pieces are configured primarily for the formation in substantially linear configurations. That is to say such conventional engageable toy brick systems use linear brick-like components which have sequentially aligned mating connectors and receptors. So configured, such are best adapted to form structures in a linear configuration such as walls and the like. Such conventional self-engaging toy brick systems are also not configured for the formation of elongated and unsupported spans.

The device and system herein, provides a toy brick configuration and engagement system which may be configured in a linear fashion, or may be formed to a pivoting or rotating engagement between the ends of two adjacent complimentary configured toy brick pieces. Thus, conventional linear walls and the like can be formed as well as curved structures. This curving configuration ability is provided by an engageable post at a first end of the toy bricks, which is adapted to rotationally engage with a complimentary socket positioned on one end of an adjacent toy brick. Through the engagement of the post and socket provided, a secure engagement of the ends is achieved which allows for linear or any number of angled positions of the two engaged pieces relative to each other.

This post and socket rotating engagement, thus, provides a secure connection between brick ends in the system herein which prevents lateral translation of the two engaged brick pieces. However, so engaged, the two pieces can be rotated from a linear orientation to form angled configurations. This angled configuration allows for curved walls and structures.

Still further, through the configuration of the mating faces of both the post end of one brick and the socket end of the adjoining brick, gaps between the two, when in an angled engagement, are eliminated by the positioning of a curved wall surface in the area of connection between the pivoting post and socket connection.

The forgoing examples of engageable toy bricks for structure building, and limitations related therewith are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The toy brick device and system herein disclosed and described provides a solution to the shortcomings in prior art and achieves the above noted objects through the provision of a toy brick system configured for either a linear engaged configuration or a pivoting engagement allowing for an angled orientation between adjoining toy bricks in the system.

Employing the disclosed toy brick configurations herein, the system allows a plurality of the toy bricks to be removably engaged in a rotational engagement with adjacent toy bricks. The pivoting or rotational engagements are provided at respective opposing ends of each of the respective toy bricks whereby substantially gapless angled wall configurations can be formed.

In all modes of the system, the upper surfaces of the toy bricks are configured with a plurality of spaced projections extending from an upper surface which are adapted to frictionally engage with recesses formed into or depending into the bottom surface of the respective toy bricks. Adjacent toy bricks may be connected in a rotational engagement by positioning the posts on a first brick in a removable engagement with apertures of the adjoining brick at an engagement angle.

Once rotated from the engagement angle, the two rotationally engaged bricks form a locked rotational engagement and will not separate until repositioned to the engagement angle. The engagement angle can vary by changing the positioning of slots providing engagements of the projections on the post of one toy brick to a side positioning rather than end positioning.

Additionally preferred in all modes of the bricks in order to maintain a static positioning of angled engagements, is a frictional or tensional contact of the two bricks joined in the rotational engagement. This is accomplished by forming the bricks to have a flange endwall or sidewall extending from a first flange of one brick to contact and frictionally engage against a recess sidewall surrounding and defining a recess which surrounds the engageable post. When the rotationally engaged bricks are rotated, this contact of the flange endwall against the recess sidewall places tension on both and upon the post in its engagement with slots.

Straight brick length, as defined by length of the front face, is determined by multiplying the distance between adjacent projection center lines (5/16") by the number of projections+1 in a row. As compared to LEGO bricks of the same length, the bricks herein have 1 fewer projection or peg per row, due to reduced length and space available at the socket end of the brick.

All brick lengths are an integer number of projection spacings times a fixed number. This length is also the distance between the vertical centerline through the socket end and the post centerline as adjusted for the pre-load offset. These lengths are consistent for most variations of bricks including curved bricks. The number of projection receptors or recesses on the bottom of the bricks is substantially equal to the number of projections on the top. This allows different styled bricks herein to be stacked together.

Curved bricks with sloping exterior surfaces stack to form cones with outwardly projecting and sloping outside surfaces or walls which extend from a first side edge of the top surface to a first side edge of the bottom of the brick (small end up) or inverted cones where the outside surface slopes away from the first side edge of the bottom toward the first side edge of the top which is wider than the bottom of the brick (small end down). The cone angle is fixed based on the height of the brick and the horizontal offset between two stacked layers of bricks. The offset is a fixed number for all layers and a slightly different fixed number for hexagons, octagons, or other polygons. The horizontal offset for a cone is created by adding length with an additional receptor (5/16") to the bottom of the cone. The horizontal offset for an inverted cone is created by adding a projection or peg (5/16") to the top of the inverted cone.

With respect to the above description, before explaining at least one preferred embodiment of the herein disclosed pivoting toy brick engagement system invention in detail, it is to be understood that the invention is not limited in its application to the details of construction and to the arrangement of the components in the following description or illustrated in the drawings. The toy brick invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other rotationally or pivotally engaged toy brick devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, by the term "substantially" is meant plus or minus five percent, unless respectively otherwise defined.

It is an object of the present invention to provide a secure pivoting engagement between two adjacent toy brick pieces employed in structure building.

It is an additional object of this invention to provide such a pivoting engagement which forms a curved or angled engagement with a minimal or no gap positioned the exterior wall between the ends of the two engaged toy bricks.

These and other objects, features, and advantages of the present toy brick system with rotating brick engagements, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed pivotally engaged play bricks. It is intended that the embodiments and figures disclosed herein are to be considered illustrative of the invention herein, rather than limiting in any fashion.

Figure 15:
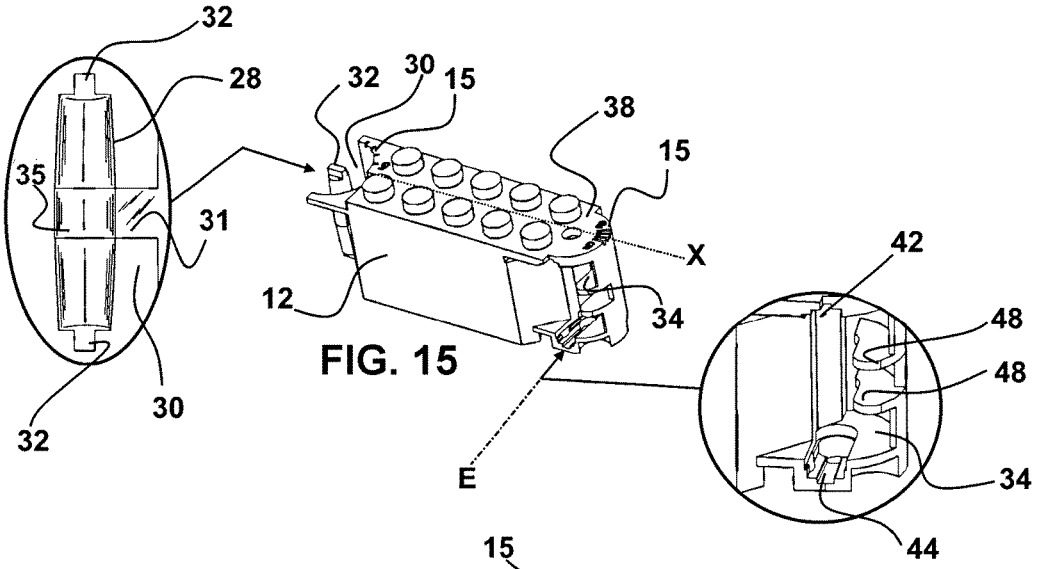

FIG. 15 depicts a particularly preferred mode of the toy brick herein, similar to that of FIGS. 1-4 but showing the slots of the socket end of the brick running substantially perpendicular to the longitudinal axis of that brick, whereby an engagement of a post end of a second brick will require a positioning substantially perpendicular or normal to the longitudinal axis. By substantially normal or perpendicular to is meant that an intersection of the post axis with the longitudinal axis X or the plane of the upper surface 20 is at between 88 and 92 degrees with 90 degrees being currently preferred, since it maintains the upper surfaces 20 and bottom surfaces 26 of all adjacent engaged bricks aligned, thereby allowing overlapped stacking of bricks 12 thereon in layers. For curved walls formed of two or more layers using straight bricks 12, the brick ends are aligned vertically to form a hinge. For rigid, flat walls different length bricks 12 may be employed so as to offset the formed hinge engaging adjacent bricks 12 in one or more layers.

Figure 16:
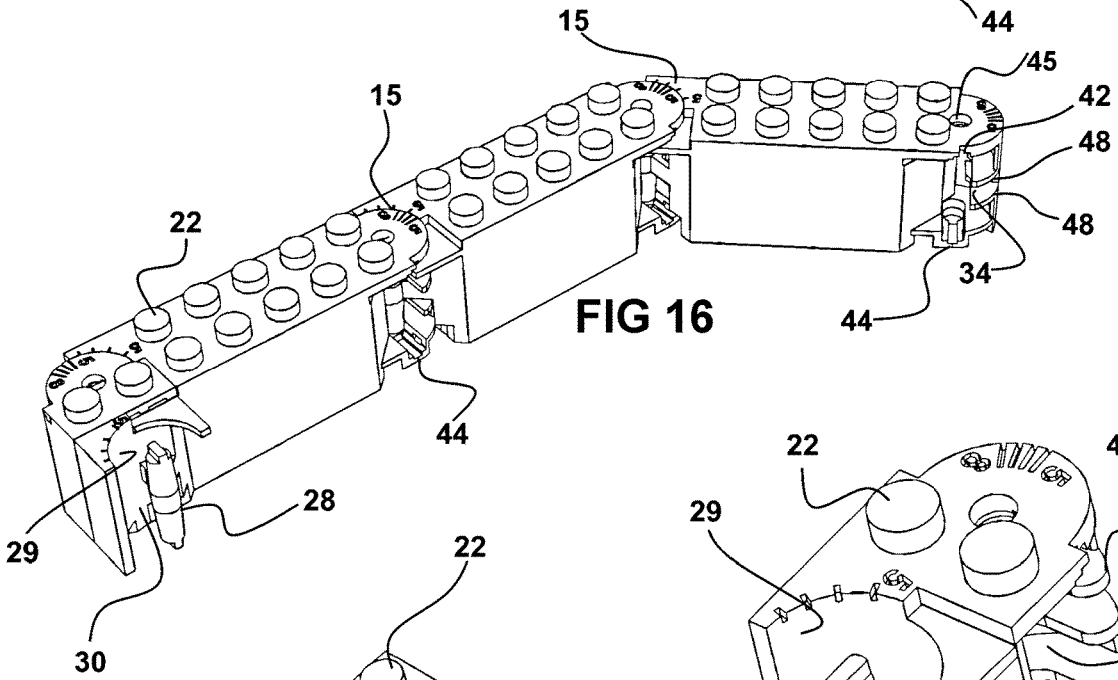
Figure 17:
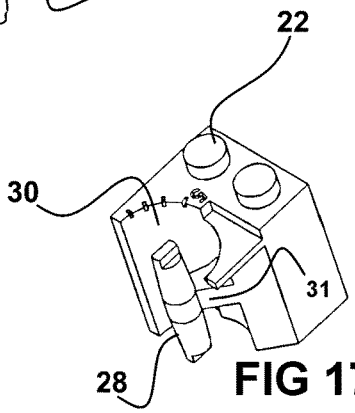
Figure 18:
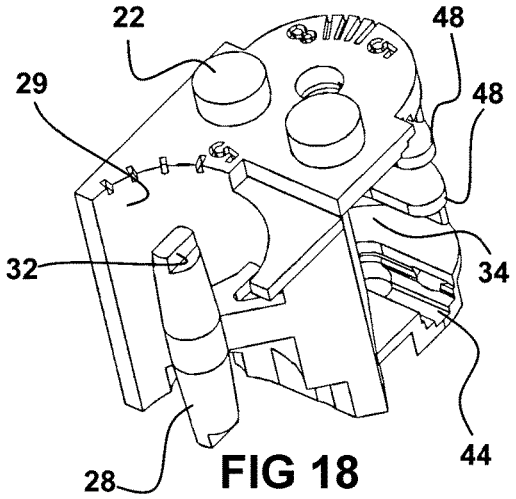

FIGS. 16-18 depict other configurations of the brick system herein which are rotationally engaged employing bricks similar to that of FIG. 15 with a convex end on a first brick rotationally engageable with a concave end on an adjoining brick and which removably engages in a similar fashion to the bricks of FIGS. 1-15.

Figure 25:
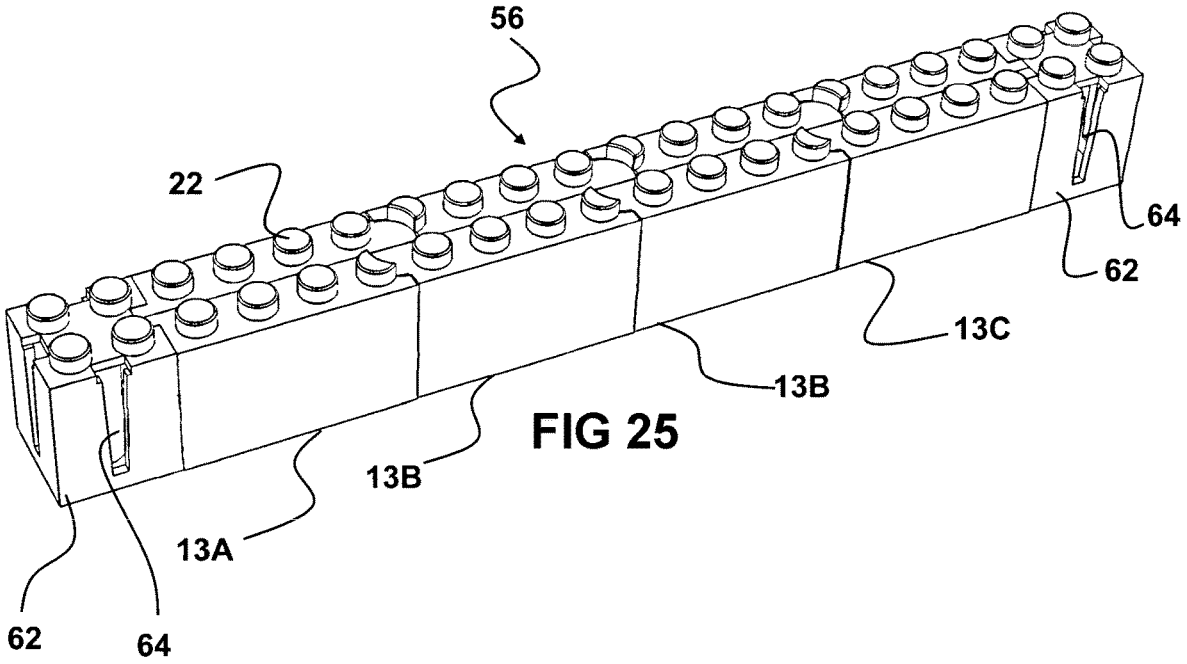
Figure 26:
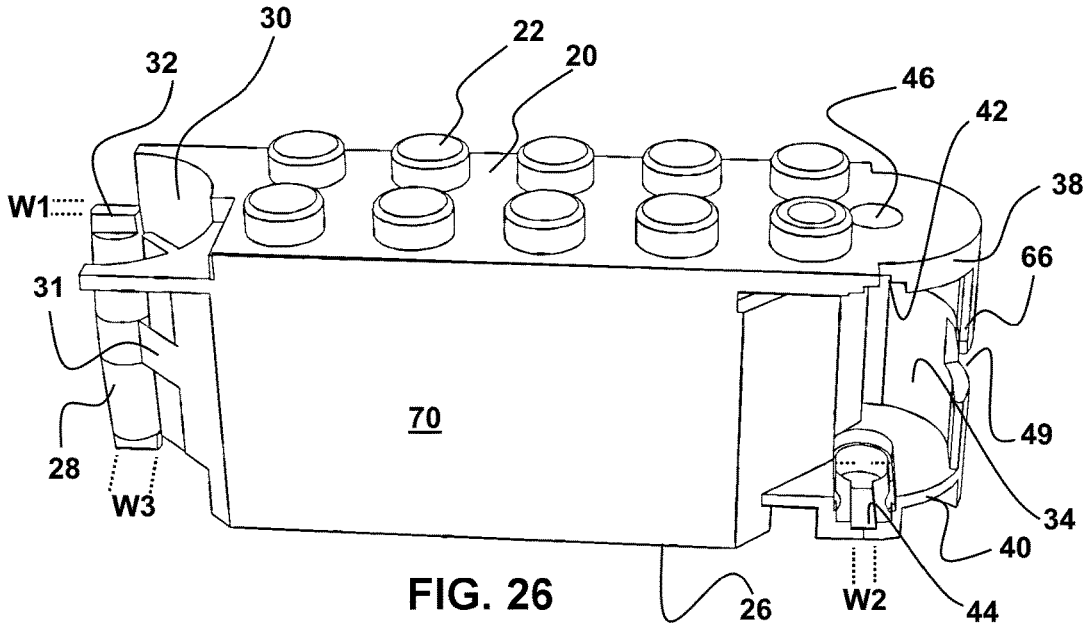

FIG. 19 depicts one configuration of a half-brick adapted to engage a mirrored half-brick to form a strut as in FIG. 25.

FIG. 20 shows a configuration of a half-brick mode adapted to engage within the central area of a formed strut in-between the half-bricks shown in FIGS. 19 and 21.

FIG. 21 depicts a mode of half-brick employable to form a strut as in FIG. 25, which is engaged to an opposite end of the strut from that of FIG. 19.

FIG. 22 shows a connector brick configured to engage the projections extending from opposing sides of a strut such as shown in FIG. 24 and provide an interface or engagement to a structure.

FIG. 23 shows a plurality of brick half sections engageable to form full bricks.

FIG. 24 shows the blocks of FIG. 23 assembled.

FIG. 25 depicts a formed strut of FIG. 24 formed of the half bricks of FIGS. 19-21 which has the slots formed in the sides of the connector bricks slidably engaged with the projections on opposite sides.

FIGS. 26-30 show views of another mode of the rotationally engageable brick system herein, wherein the guide for the centrally located mount supporting the post is provided by a slot formed in a sidewall defining the recess in which the post of an adjoining brick is rotationally engaged.

Figure 31:
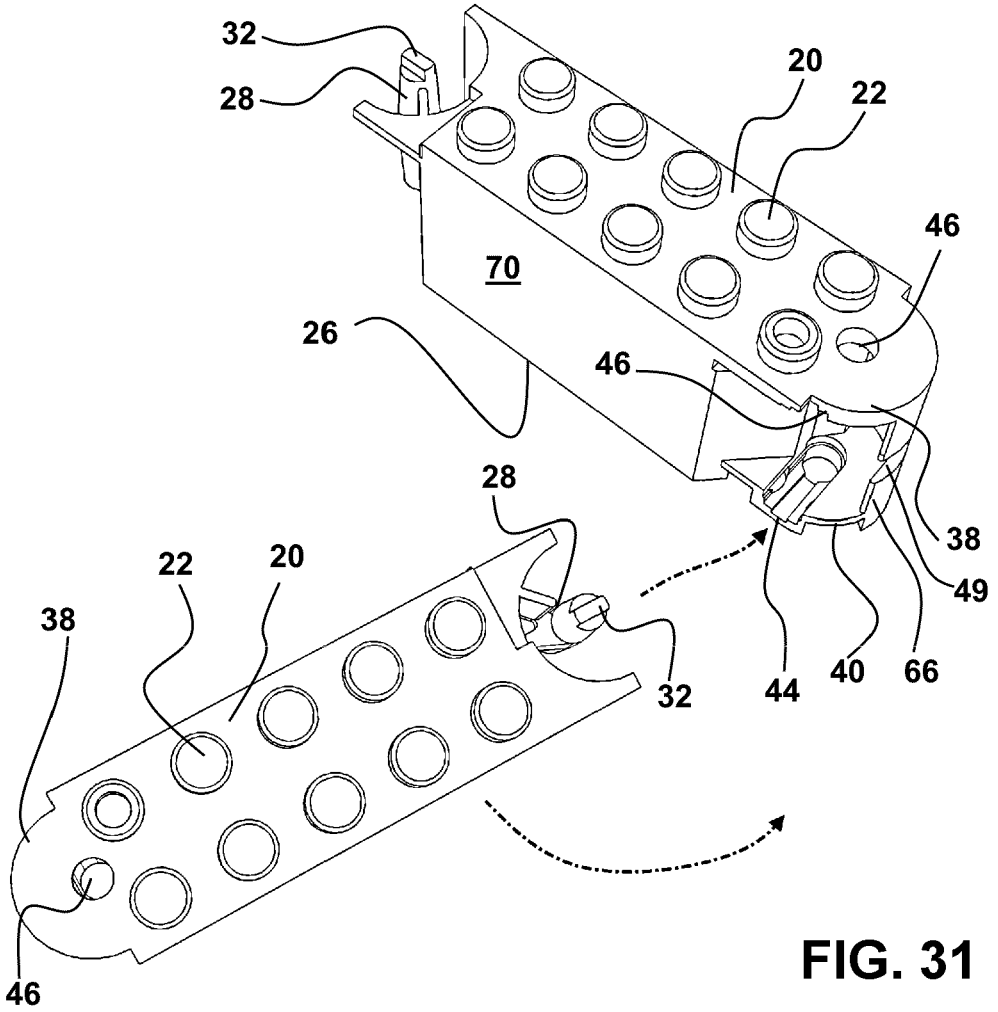

FIG. 31 depicts the engagement of an adjoining brick with a first brick through positioning of a post within slots formed in opposing flanges within the recess, whereby rotation, once inserted, positions the support for the mount within the slot in a sidewall.

Figure 32:
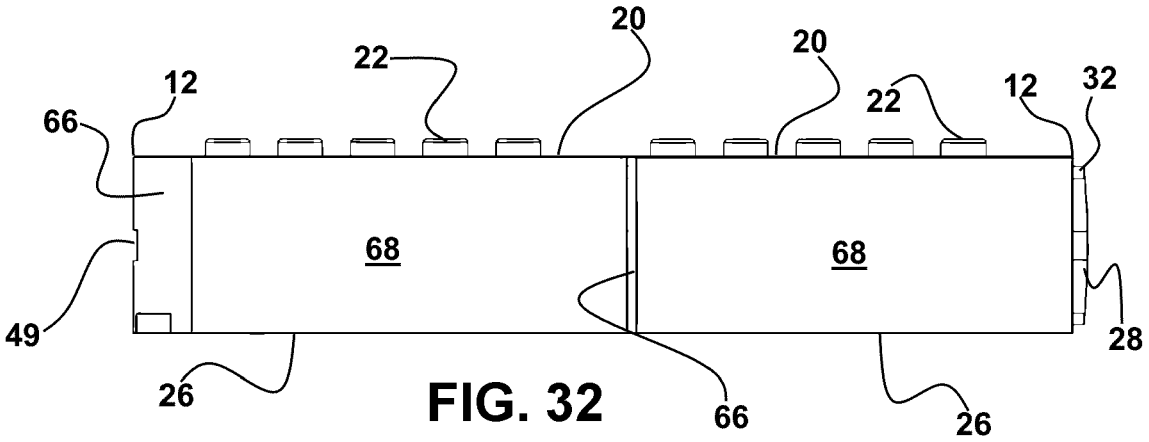

FIG. 32 depicts the bricks from FIG. 31 engaged from a side view.

Figure 33:
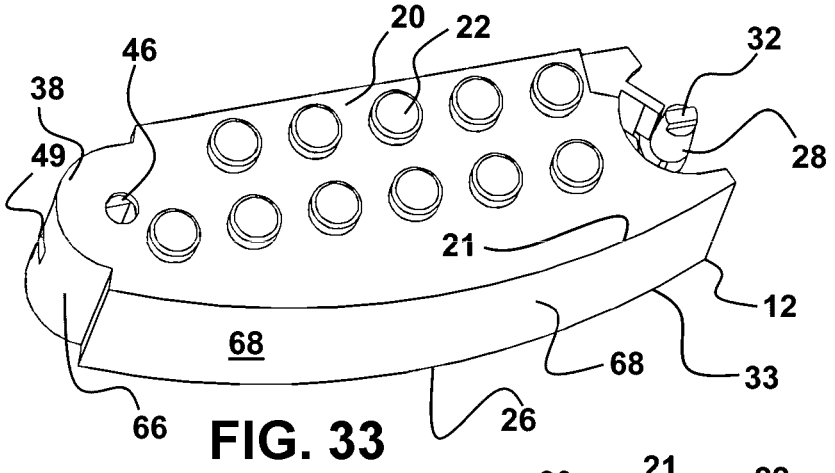
Figure 34:
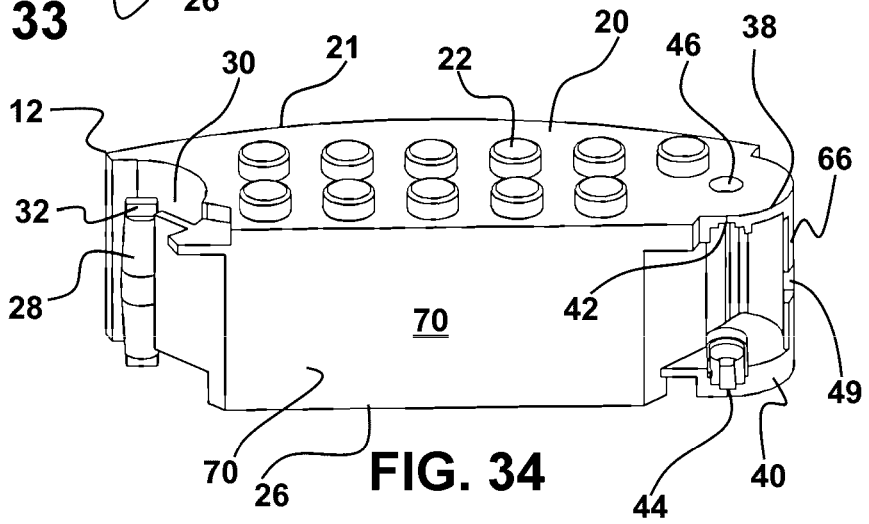
Figure 35:
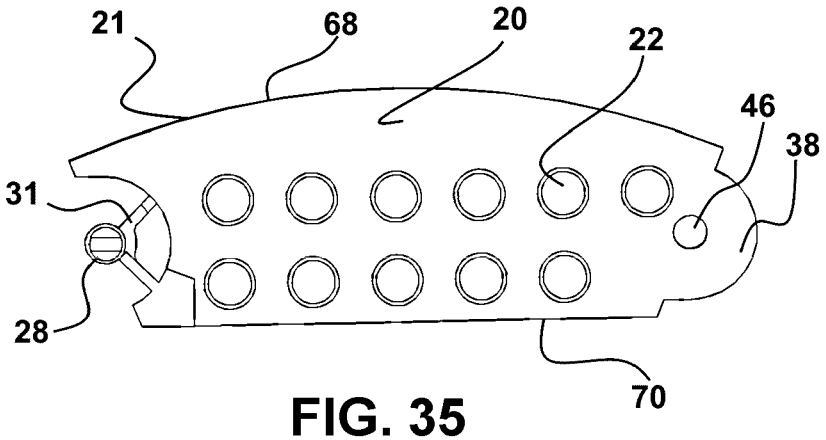
Figure 68:
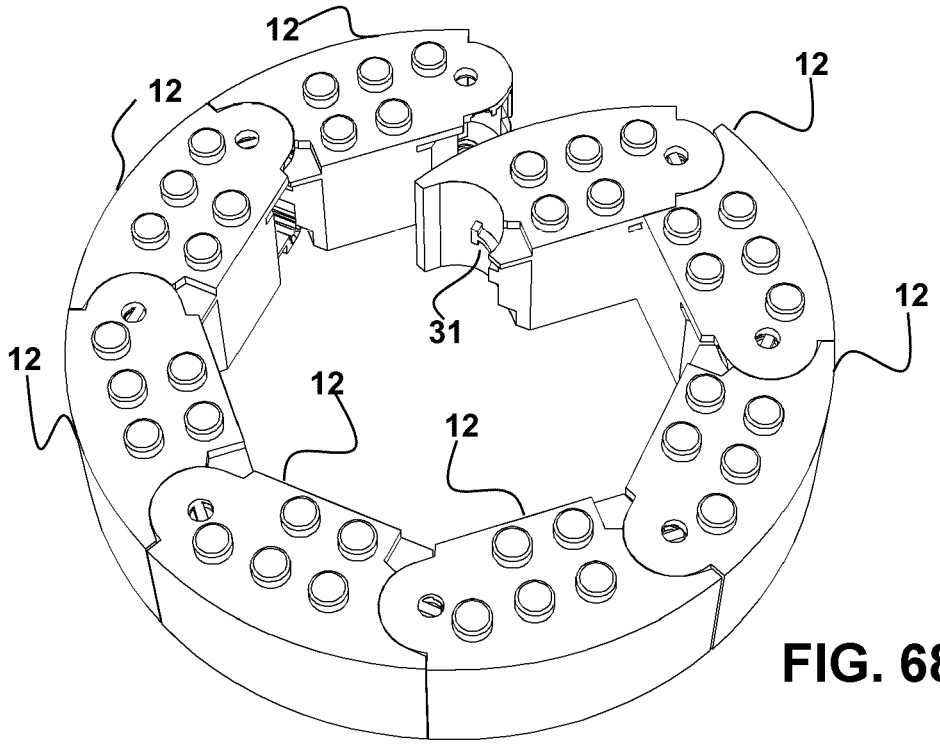
Figure 69:
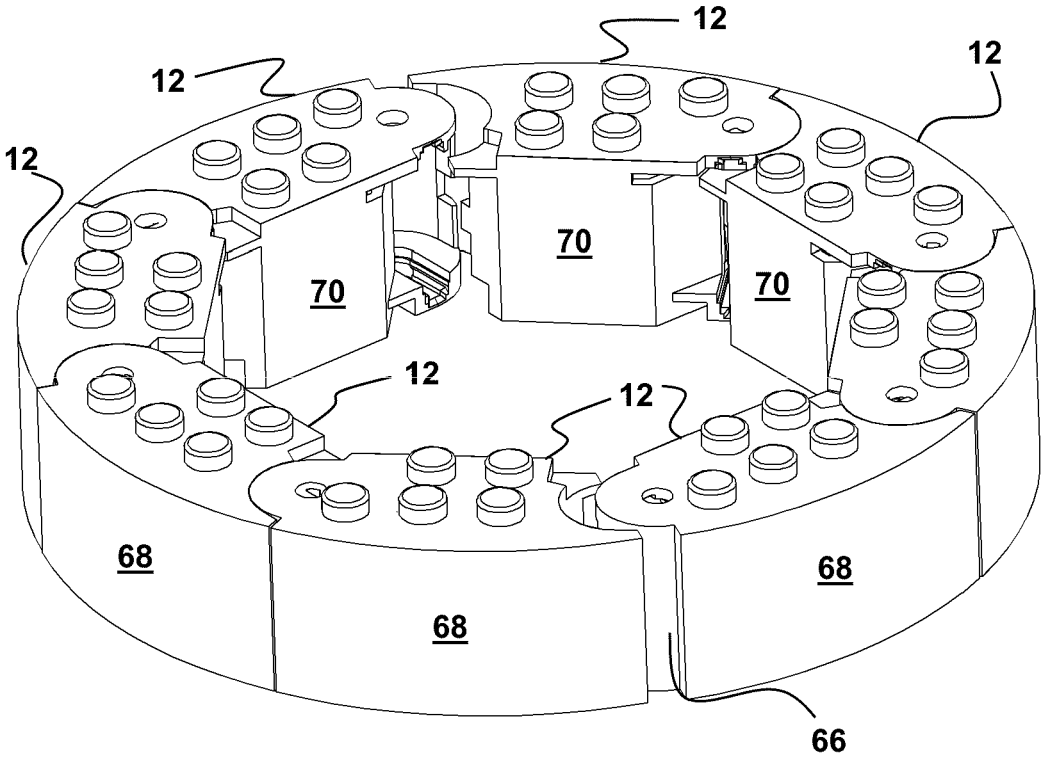

FIGS. 33-35 depict a mode of the rotationally engageable bricks, herein, having a curved outer wall for formation of curved structures such as shown in FIGS. 68-69.

Figure 36:
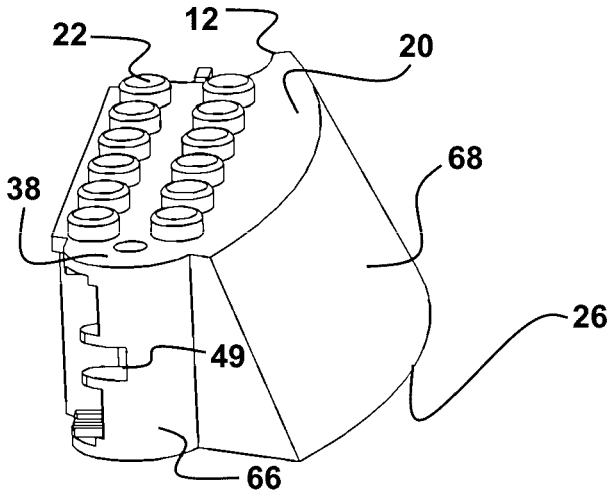
Figure 37:
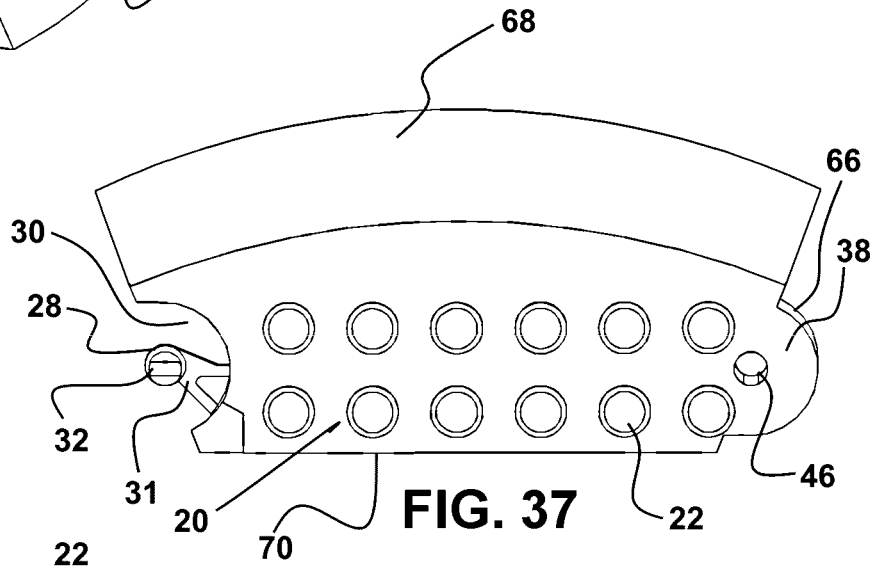
Figure 38:
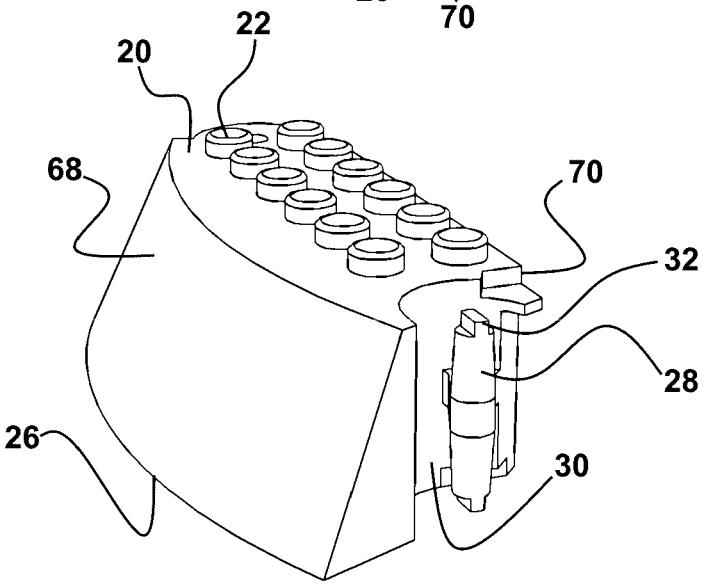
Figure 39:
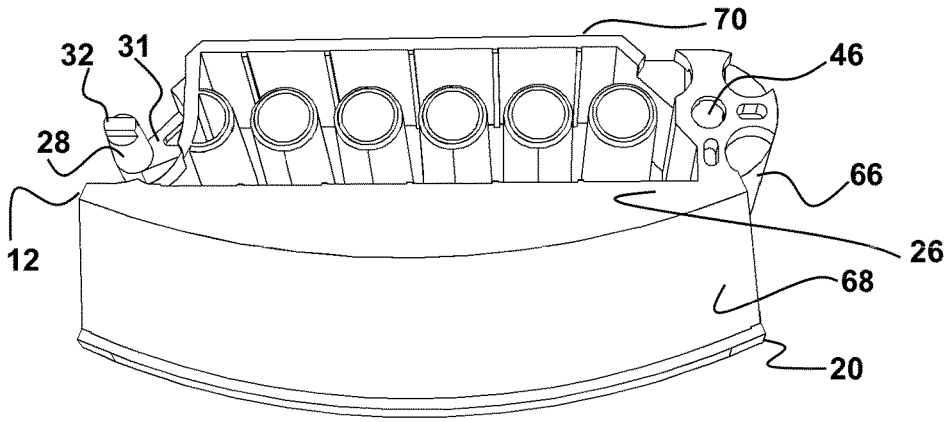
Figure 40:
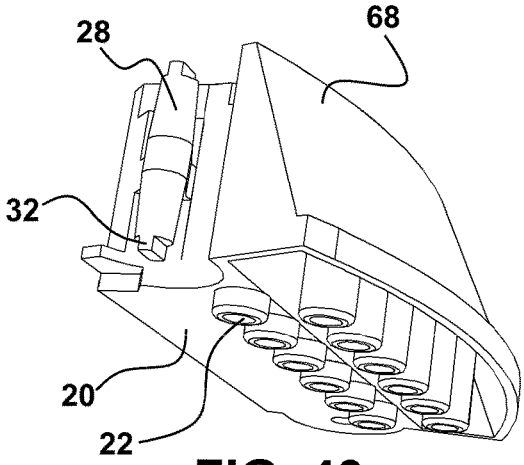
Figure 41:
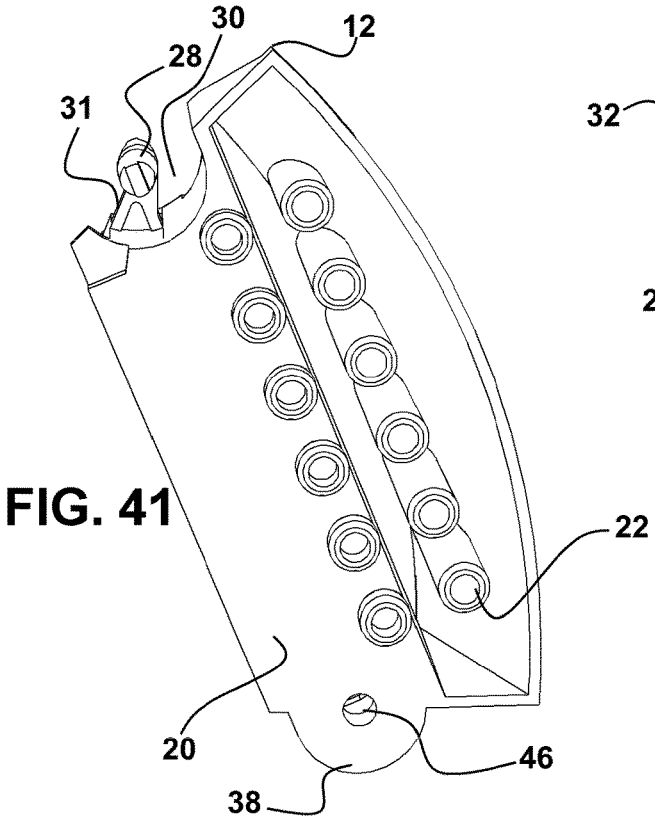
Figure 42:
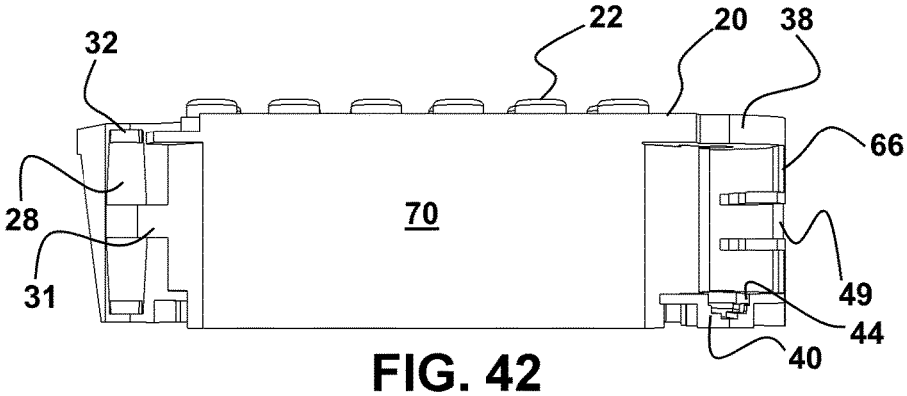
Figure 43:
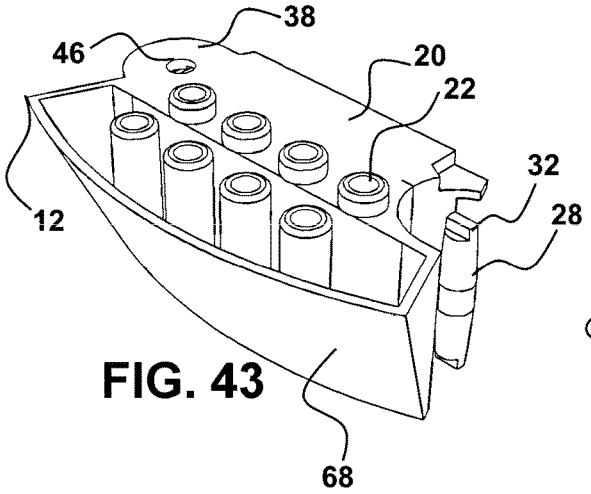
Figure 44:
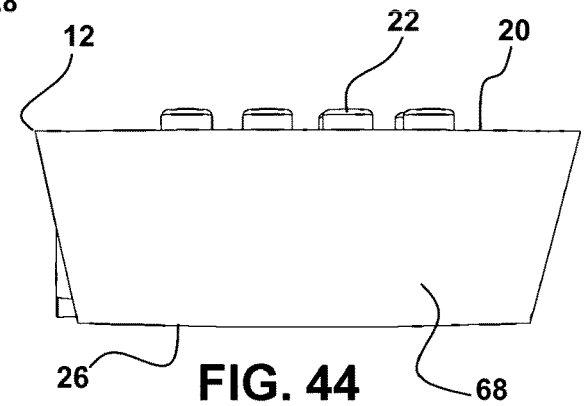
Figure 45:
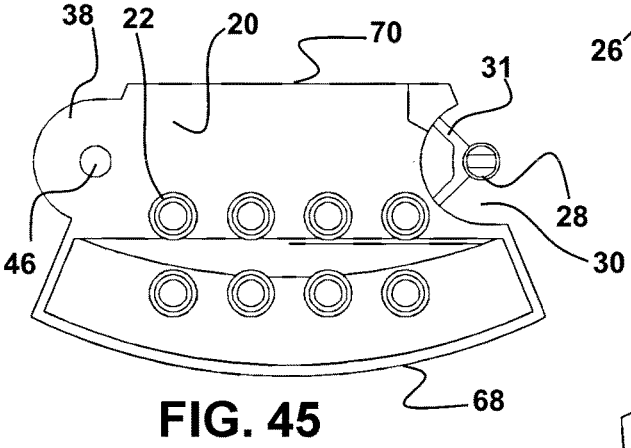
Figure 46:
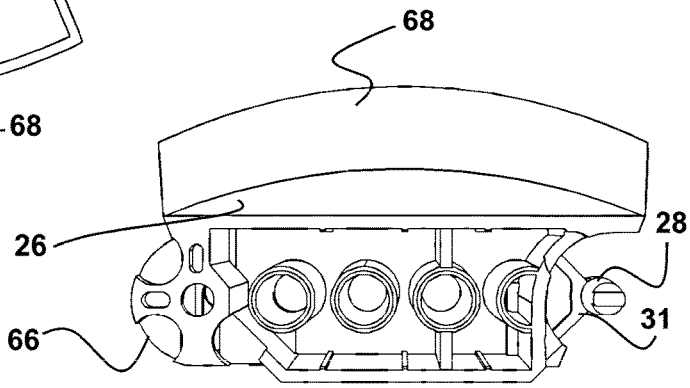
Figure 47:
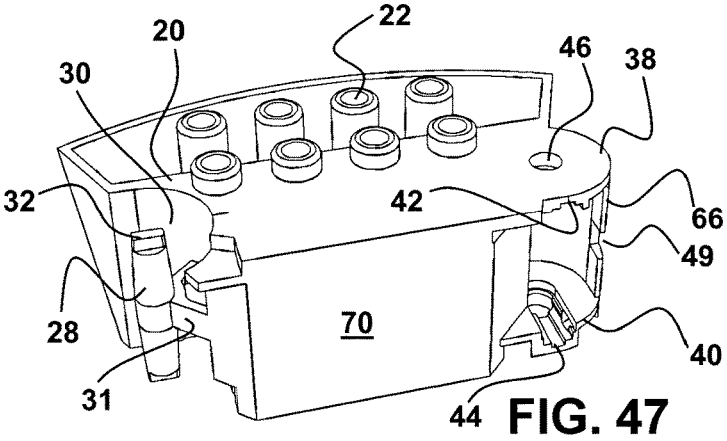
Figure 48:
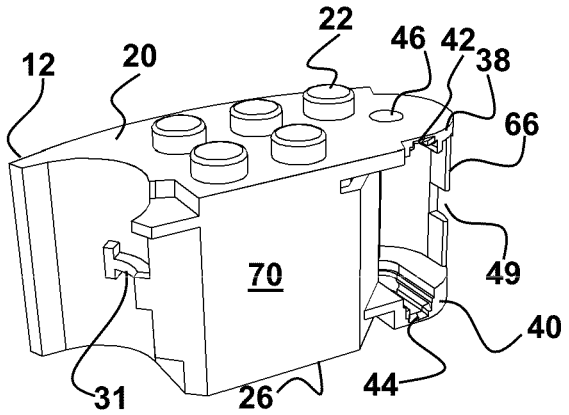
Figure 49:
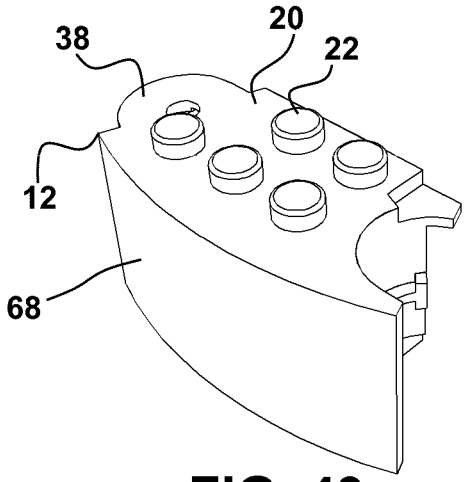
Figure 50:
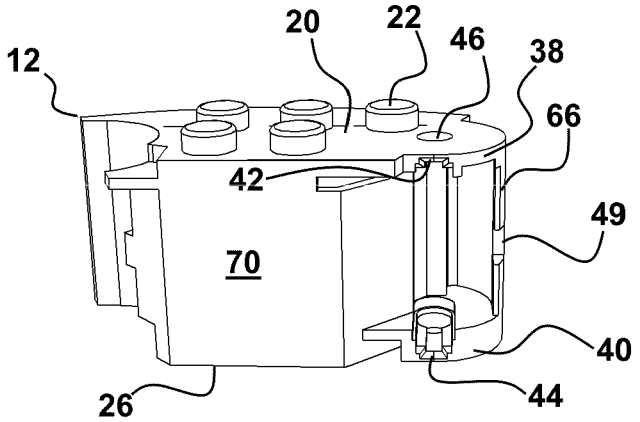
Figure 51:
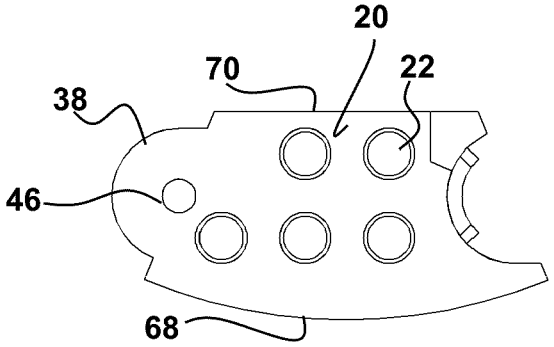
Figure 52:
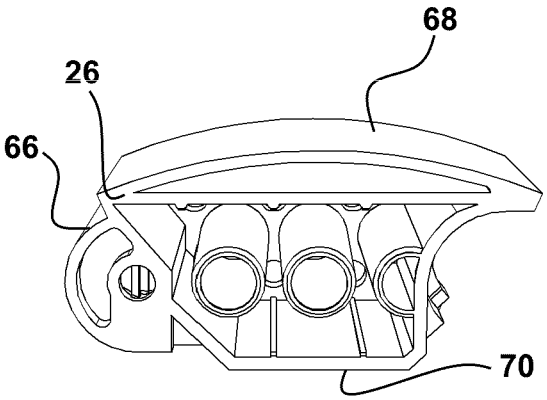
Figure 53:
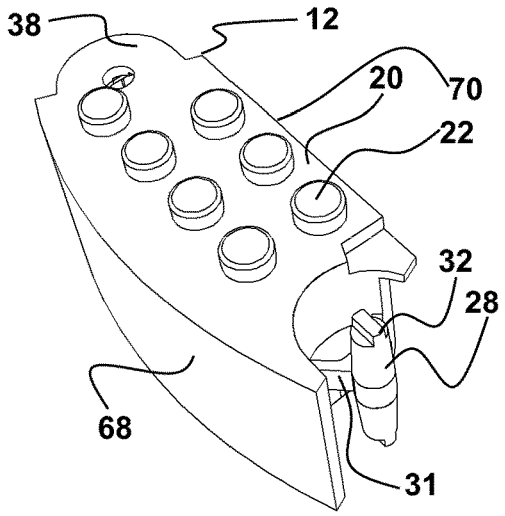
Figure 54:
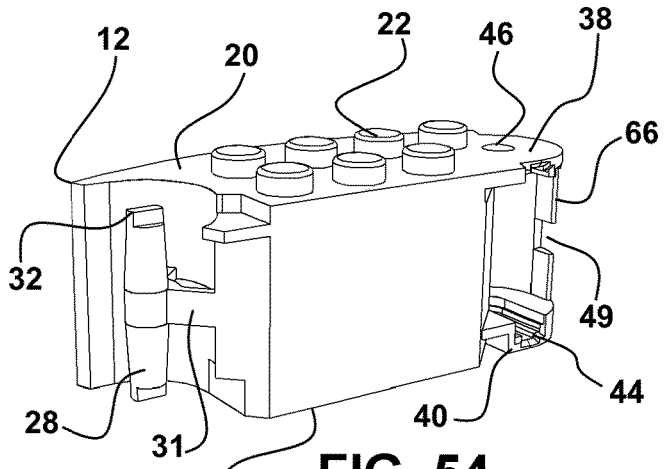
Figure 55:
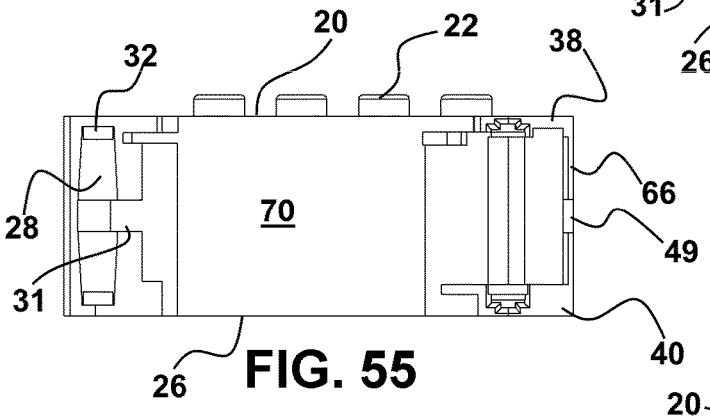
Figure 56:
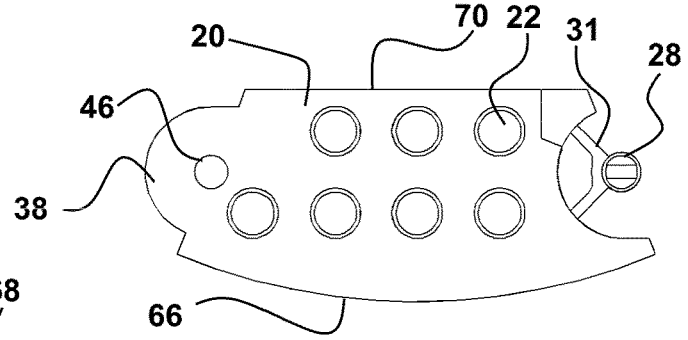
Figure 57:
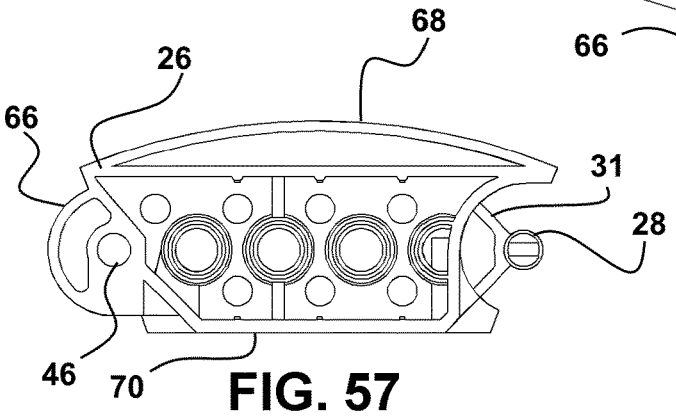
Figure 58:
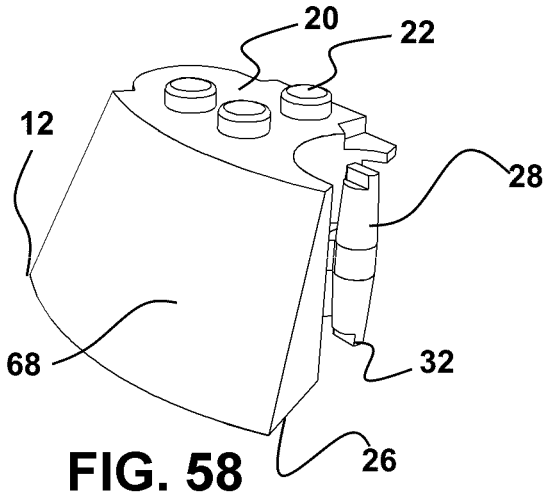
Figure 59:
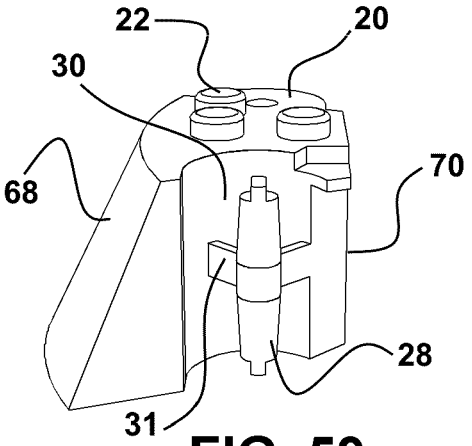
Figure 60:
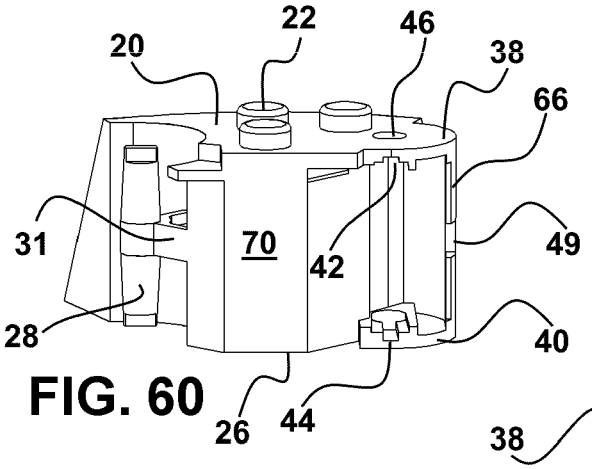
Figure 61:
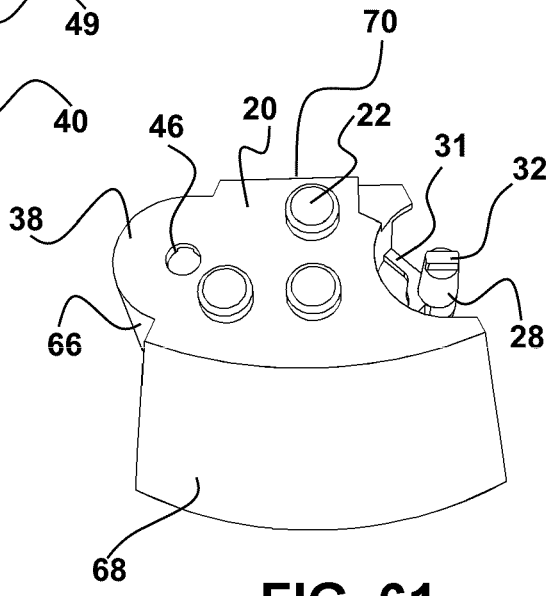
Figure 62:
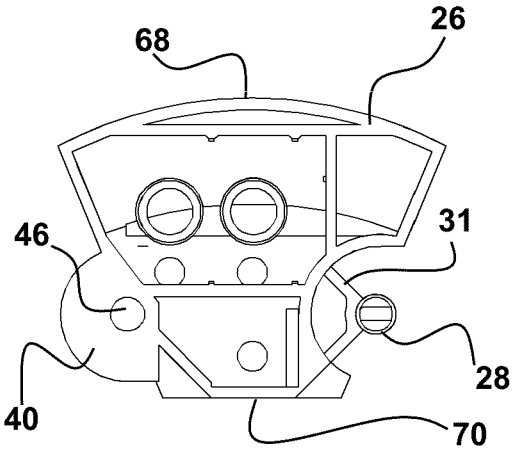
Figure 63:
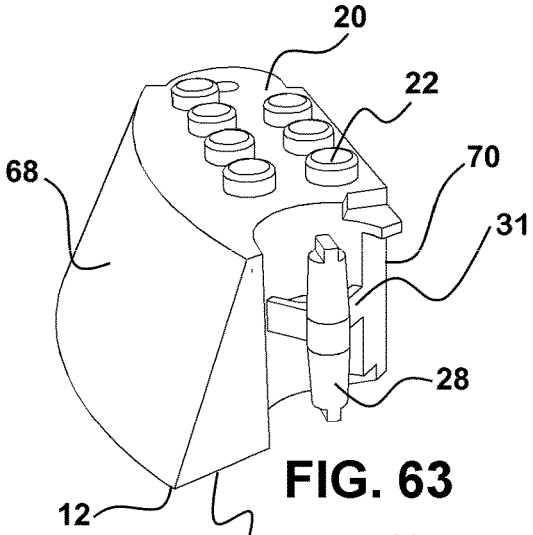
Figure 64:
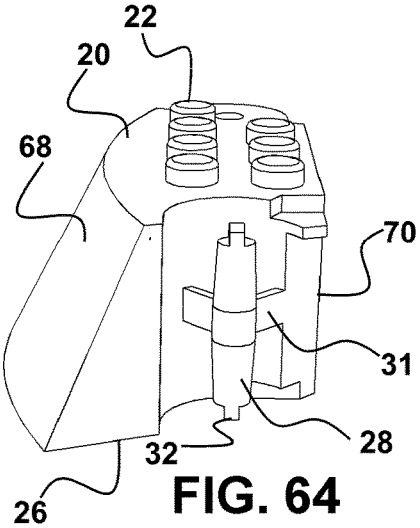
Figure 65:
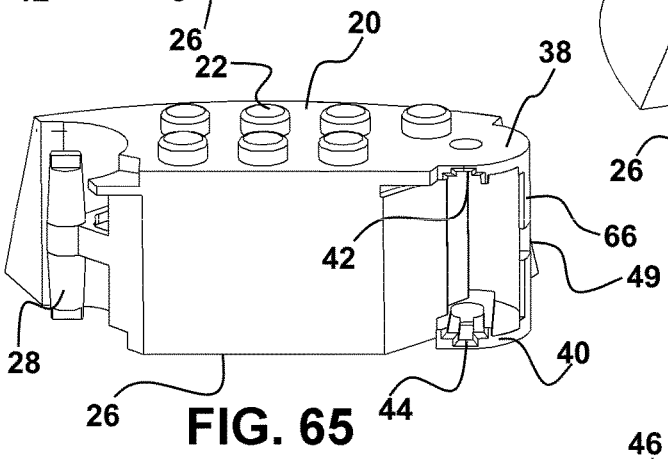
Figure 66:
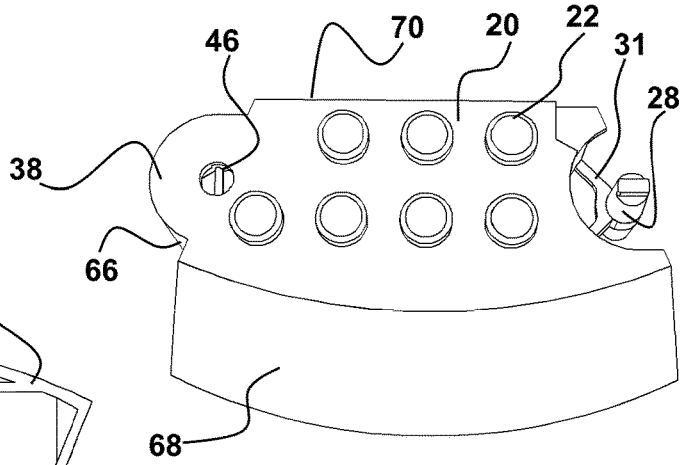
Figure 67:
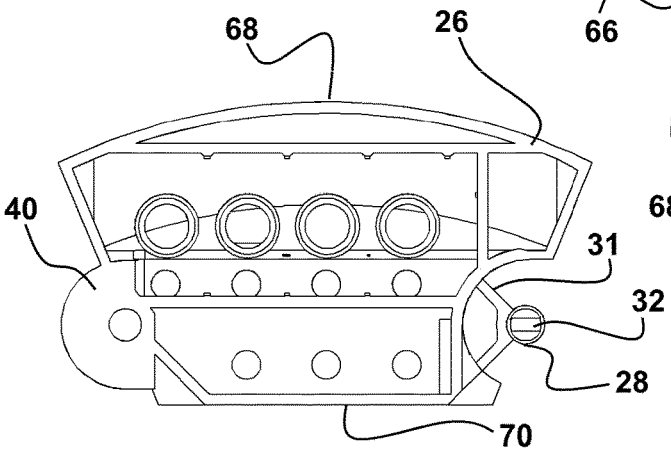
Figure 70:
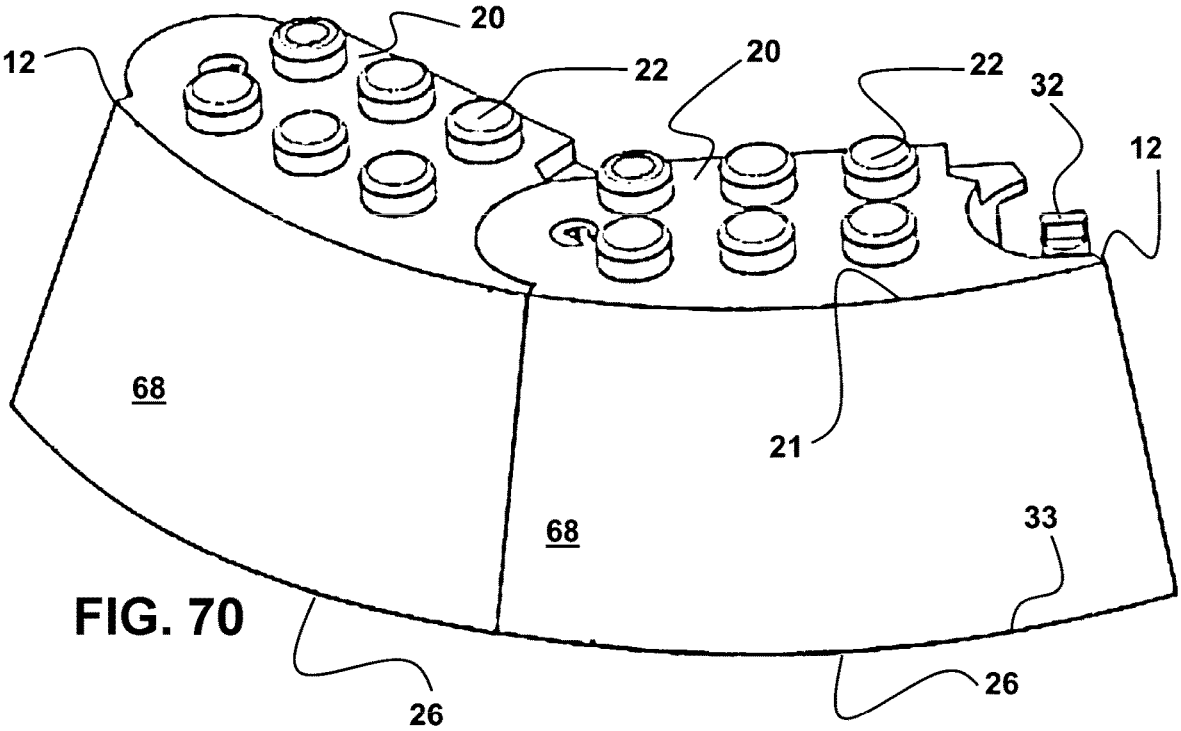
Figure 71:
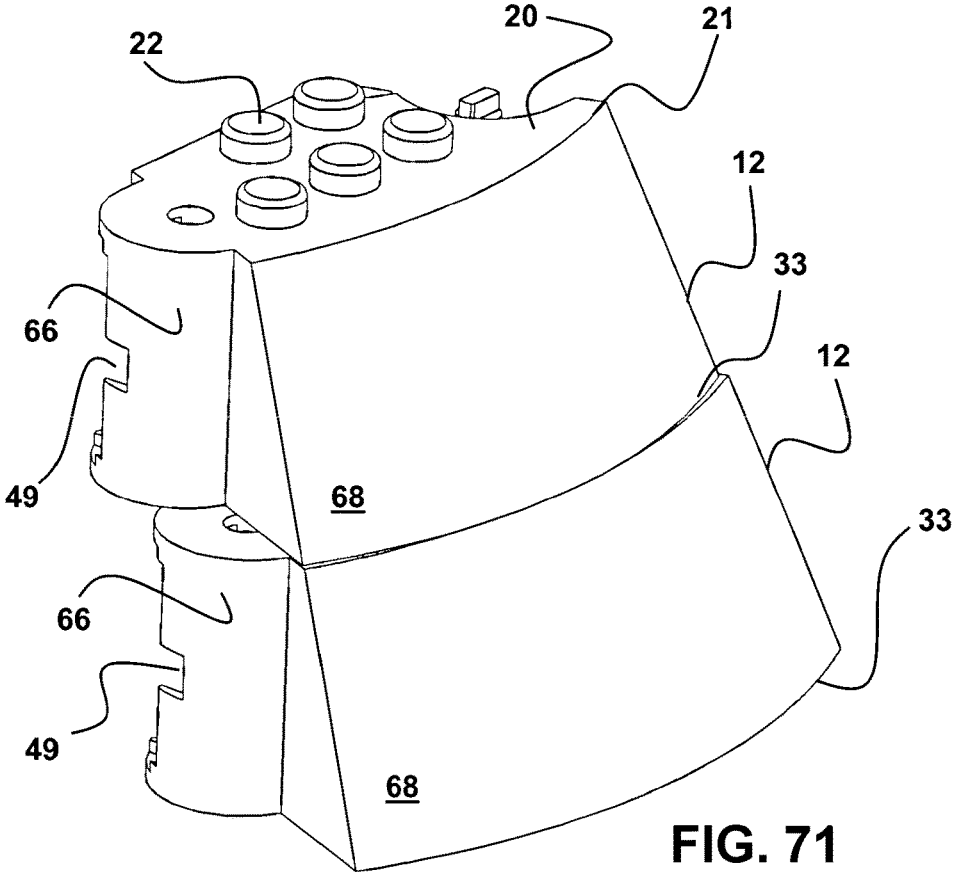

FIGS. 36-38 depicts a mode of the rotationally engageable bricks for the system herein having a slanting or tapered exterior wall in combination with forming a curved exterior wall where the brick is wider at a bottom of the brick and narrower at a top, and the bricks are engageable to form curved multi layer narrowing structures such as in FIGS. 70-71.

FIGS. 39-42 show a mode of the brick employable in the system herein, featuring an outward tapering exterior wall similar in structure and function to that of FIGS. 36-38.

FIGS. 43-47 show another mode of the brick employable in the system herein, formed in an inverted angled exterior wall configuration having a curved exterior sidewall slanting from a narrow bottom end of the brick to a wider top end.

FIGS. 48-52 show views of a brick having engageable ends employed in the system herein, wherein the post and support are missing from the end opposite the recess and are employable in forming circular configurations such as in FIGS. 68-69 by engaging a T-shaped mount into a notch.

FIGS. 53-57 depict a mode of the brick system, herein, showing that the length of any of the bricks, herein, with straight or with tapering exterior sidewalls, can be varied.

FIGS. 58-62 show a brick of the system herein similar in structure and function to that of FIGS. 36-38 and showing the curved bricks with tapering exterior walls can be shorter or longer and formed essentially in any length as pieces of a kit.

FIGS. 63-67 also show a brick configuration for the system herein, having a length longer than that of FIGS. 58-62 but shorter than that of FIGS. 36-38.

FIG. 68 shows a circular configuration being formed of bricks such as those of FIGS. 53-57 and having a terminating brick such as in FIGS. 48-52 engaged at one end.

FIG. 69 shows the bricks of FIG. 68 sequentially engaged and showing the terminating brick without a post thereon nesting around a first end of brick on the opposite end of the string of bricks.

FIG. 70 shows two adjoining bricks similar to those of FIG. 63-67 engaged to form an outer wall surface which curves and forms a substantially gapless exterior surface.

FIG. 71 depicts the ability of convergent style bricks, such as those in FIG. 63-67, to form a stacked structure where the bottom exterior edge of each brick stacked upon a lower brick is substantially flush and aligned with the top edge of the exterior wall of the lower brick.

DETAILED DESCRIPTION OF THE INVENTION

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Figure 1:
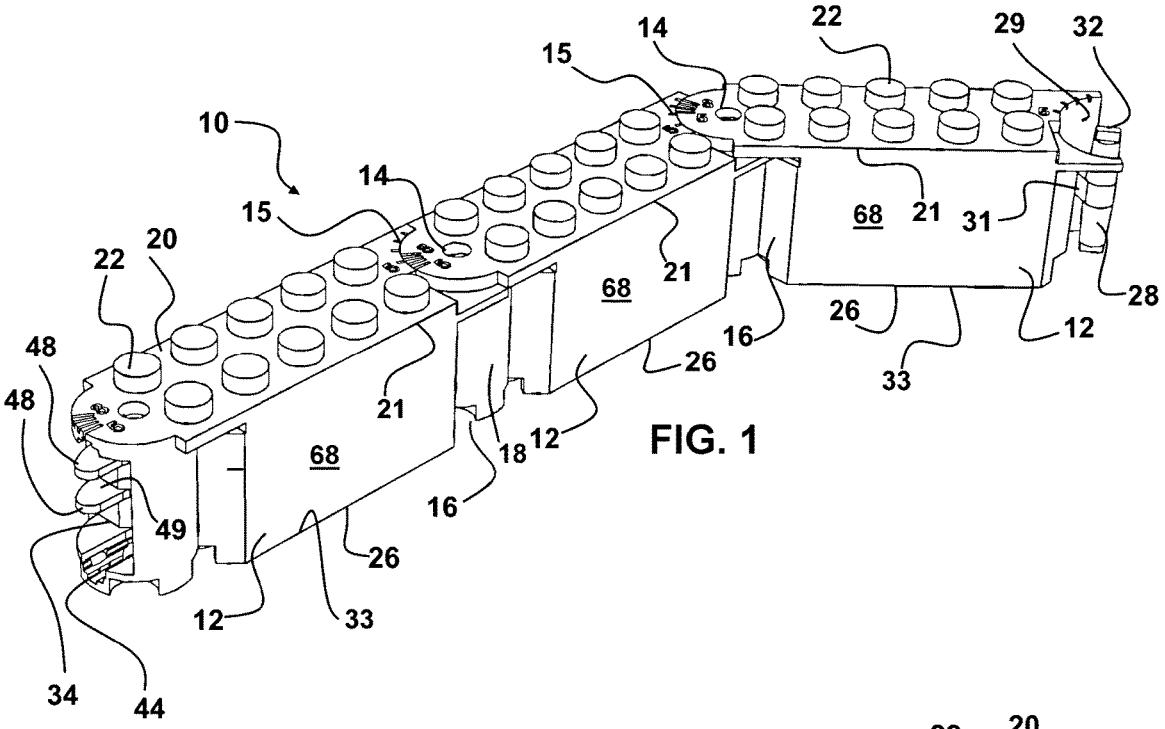
FIG. 1 depicts an exterior perspective view of a plurality of the bricks herein in rotational engagements.
Figure 2:
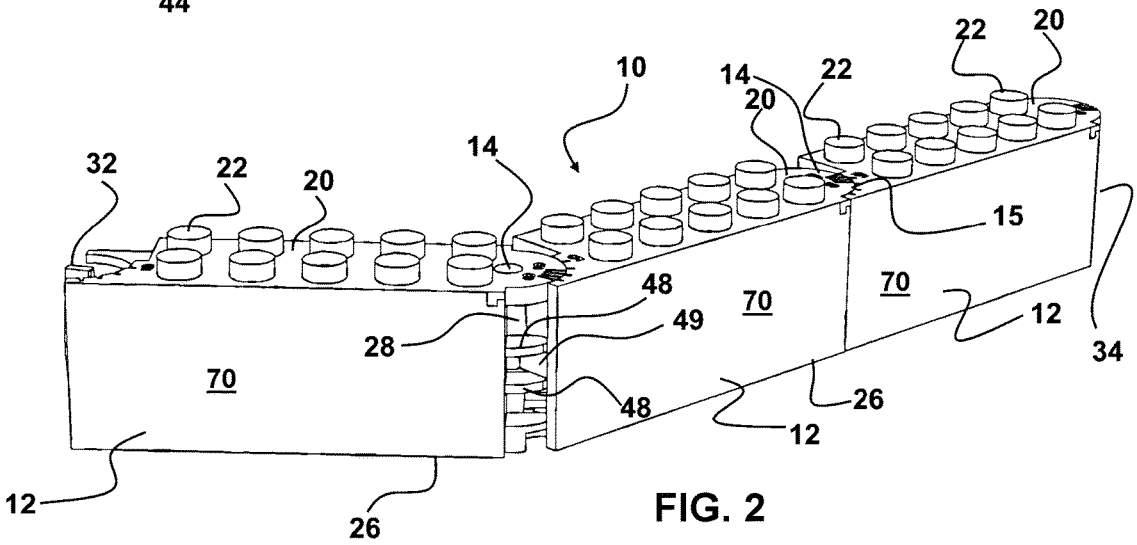
FIG. 2 depicts the opposite side view of the bricks in rotational engagements in FIG. 1.
Figures 9, 10, 11, 12, 13, 14:
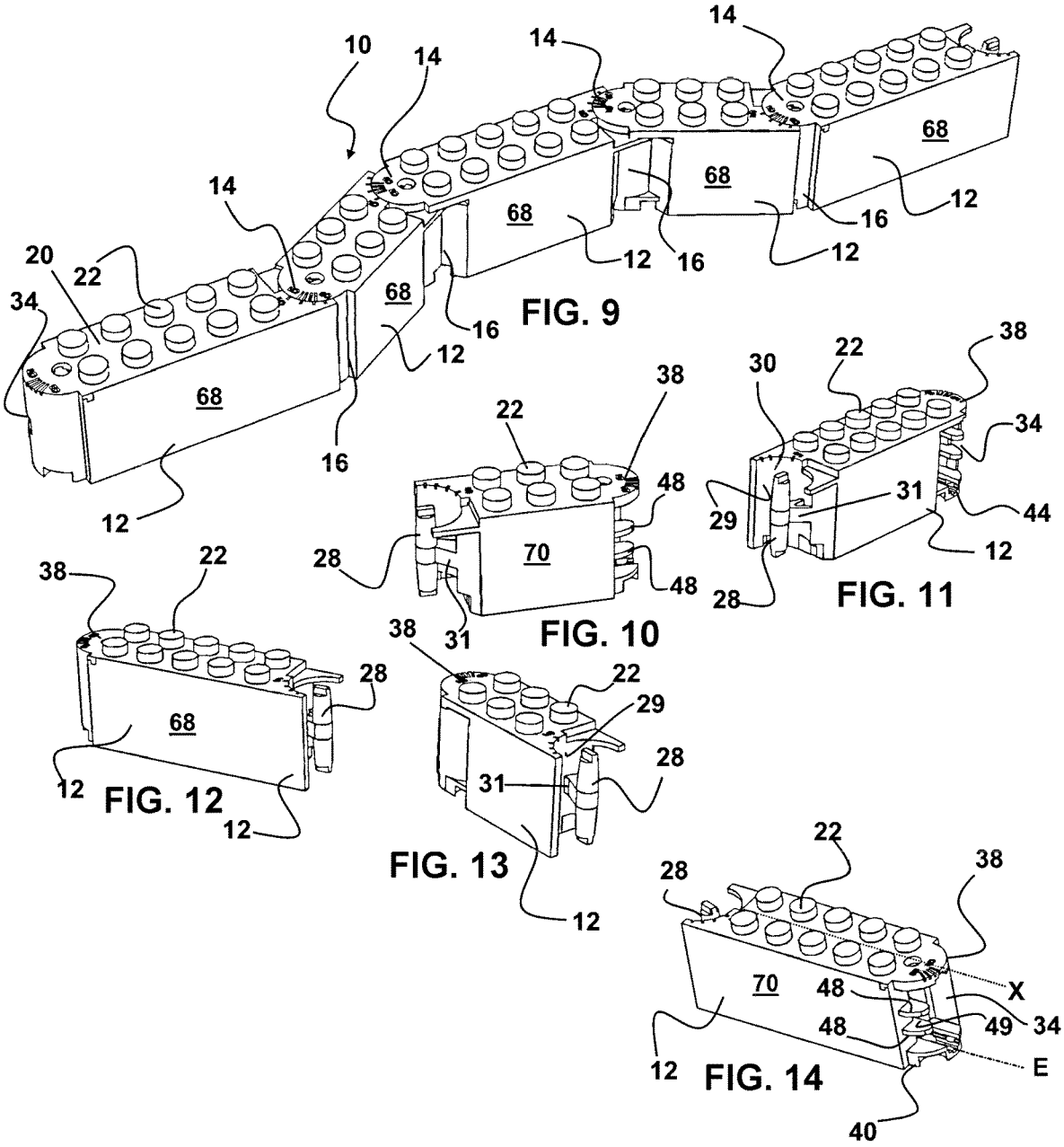
FIG. 9 shows a perspective view of a serpentine configuration of a brick wall which is achieved with the brick system herein and shows that bricks may vary in length and engagement direction.
FIGS. 10-13 depict various perspective views of the bricks engaged in FIG. 9.
FIG. 14 shows the toy brick device herein showing the slot in the socket end, aligned with the longitudinal axis of the toy brick.

Now referring to drawings in FIGS. 1-71, there are depicted and described similar components which are identified by like reference numerals. FIGS. 1-2 depict a series of bricks 12 linked together in a sequence or chain, to form a concave exterior wall viewing surface such as shown in FIG. 9, where central located bricks 12 curve while the two end bricks 12 form transitions from the curving or concave shape, to a straight or convex shape of the more commonly used bricks shown in FIGS. 15-18. For example, in FIG. 16 is shown a back surface view of commonly used bricks 12 herein opposite the view from FIG. 9, which can be arranged as straight beams or closed polygons.

In preferred modes of the system 10, bricks 12 have a body which is configured with a post 28 at a first end of the body which is configured for a removable rotational engagement with a socket 34 at a second end of the body of adjacent bricks 12. The post 28 runs along a line or post axis 17 (FIG. 3), which is substantially normal to the plane of the upper surface 20, or perpendicular to the longitudinal axis X (FIG. 15) of the brick 12.

Further preferred is that each brick 12 has a first side surface configured for positioning on a viewed or exterior surface 68 (FIG. 9) of bricks 12 forming a structure. This first side surface or exterior surface 68, extends downward from the upper surface 20 from a first side edge 21 of the upper surface 20, to a second side edge 33 at the bottom surface 26, in all modes of the device 10 whether having a planar or curved exterior surface 68. On structures formed of stacked bricks 12, the plurality of adjoining bricks 12 all will have a respective exterior surface 68 facing the outside of the formed structure, such as in FIG. 9 or in the case of curved bricks 12, FIG. 69. The plurality of engaged bricks 12 in such structures will have respective inside surfaces 70 which are meant to be substantially out of view.

The many styles of bricks 12 herein (straight, circles, octagons, flared in or flared out) all have two aligned and parallel rows of pegs or projections 22 extending from the upper surface 20. Additionally common to all bricks 12 herein, is that recesses 24 in the bottom surface 26 form receptors for the projections on underlying bricks 12, which allow for stacking of similar size rings of any style bricks 12 together.

This preferred configuration allows sequentially engaged bricks 12 to form aligned linear rotationally engaged configurations as with conventional bricks 12. It also allows the bricks of the system when locked in a rotational engagement to be rotated individually to form angles curves and other non linear configurations of engaged bricks 12 and stacks thereof. The bricks 12 may also be configured to engage with conventional toy bricks such as those manufactured by LEGO, in that they have spaced projections 22 on a top or upper surface 20, and have an opposite bottom side adapted to frictionally engaged such projections 22 on an underlying brick 12.

In FIG. 1 is shown an exterior perspective view of one mode of the rotational engagement toy brick system 10 herein. The bricks 12 as shown are in an as-used configuration, with a plurality of the toy bricks 12 herein, each in a rotational engagement with adjacent toy bricks 12, at respective opposing ends of the respective bricks 12 and forming the serpentine wall. As can be seen in FIGS. 1 and 9 for example, the gaps 16 between pivotally connected bricks 12, are substantially filled with a wall surface 18, leaving the exterior facing wall surface substantially gapless. Such a gapless exterior wall surface is provided whether the adjoining bricks are aligned or positioned at a variable an angle to each other. Such a filled result of the viewable exterior wall of the engaged bricks 12 is preferred. This is because builders of structures with such toy bricks 12 prefer a minimum of unfilled exposed exterior wall surfaces in the resulting structure.

In all modes of the system 10 herein, upper surfaces 20 of the body of the brick 12 preferably include a plurality of spaced projections 22. These projections 22 are positioned and sized to frictionally engage within a recess 27, depending into a bottom of the body of the brick 12. The number of such projections 22 varies depending on the length of the brick 12 between the first and second end, which may vary. Such a configuration of the projections 22 will frictionally engage them within circular recesses 27 (FIGS. 7-8) located in the bottom 26 of the respective bricks 12 herein and a sidewall 23 of the body of the brick 12 which extends around the recess 27 depending into the bottom of the body of the brick 12. Also shown in FIG. 1 and common to all modes of the device herein, an exterior wall 68 extends between a first side edge 21 of the upper surface 20 and a second side edge 33 of the bottom surface 26 of each brick 12. In formed structures of bricks 12 with either planar exterior walls 68 or curved exterior walls 68 such as in FIGS. 33-71, the exterior wall 68 is intended to be the viewed exterior wall of a stack structure rows of bricks 12 engaged to each other and on top of lower rows of such bricks.

In a well known frictional engagement configuration such as that employed by LEGO and other conventional bricks, projections 22 extending above the top surface of the body of bricks 12 frictionally engage against and in between a wall 25 forming the circular recesses 24 and a sidewall 23 of the brick 12 surrounding the recess 27 depending into the bottom of the body of the brick 12. However, such well known conventional engagements of conventional toy bricks 12, lack a rotational engagement ability and an engagement system which forms curves and angles in the resulting formed structures.

Shown in FIG. 2, is an opposite side or interior wall view of the bricks 12 in rotational engagements 14, of FIG. 1. In this rear view, the gap 16 formed between adjacent bricks 12 which are in a removable rotational engagement 14, positioning the bricks 12 at an angle to each other, is generally not visible in a formed structure. This is because the rearward facing surface is not seen in a completed structure formed of the engaged toy bricks 12. Thus, a substantially solid viewable or exterior surface is provided such as in FIG. 1, where adjacent bricks 12 are in a straight configuration or in a convex angled configuration, and the rear surface is in a straight or convex configuration.

Figure 3:
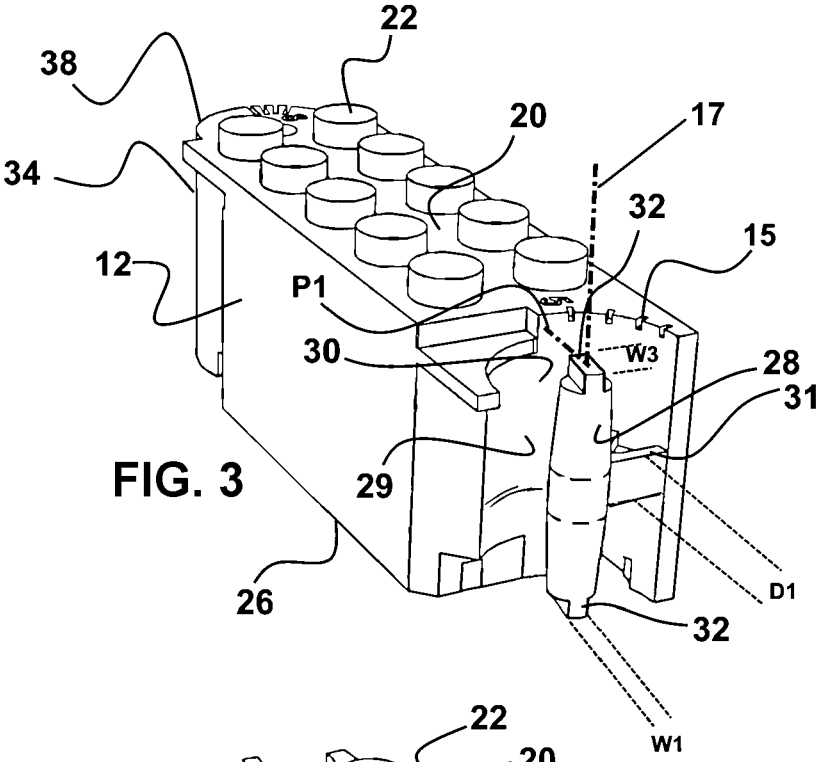
FIG. 3 depicts a perspective end view of the post end of the bricks herein which is adapted for rotational engagement with the socket end shown in FIG. 4.

In FIG. 3, is depicted a perspective end view of a mode of a toy brick 12 according to the system 12 herein, which may vary in length or can be provided in a plurality of lengths. The brick 12 has a first end with a projecting post 28 extending from a centrally located mount 31 which extends between the first end of the brick 12 and the post 28. Common to all modes of the device 10 hereing, a recess 30 or void defined by a recess sidewall 29, surrounds the entire post 28 but for the area intersected by the mount 31. The mount 31 has diameter D1, extending between the first end of the brick 12 and the post 28.

Preferably in all modes of the brick 12 herein, at opposing ends of the post 28 are located post projections 32. Both of the elongated post projections 32 have a width W1 which is narrower than the width of the post 28 and both projections are axially aligned with each other. These post projections 32, in all modes of the system 10, provide a means for removably engaging the post 28 to a rotational engagement on one end of an adjacent brick 12.

Figure 4:
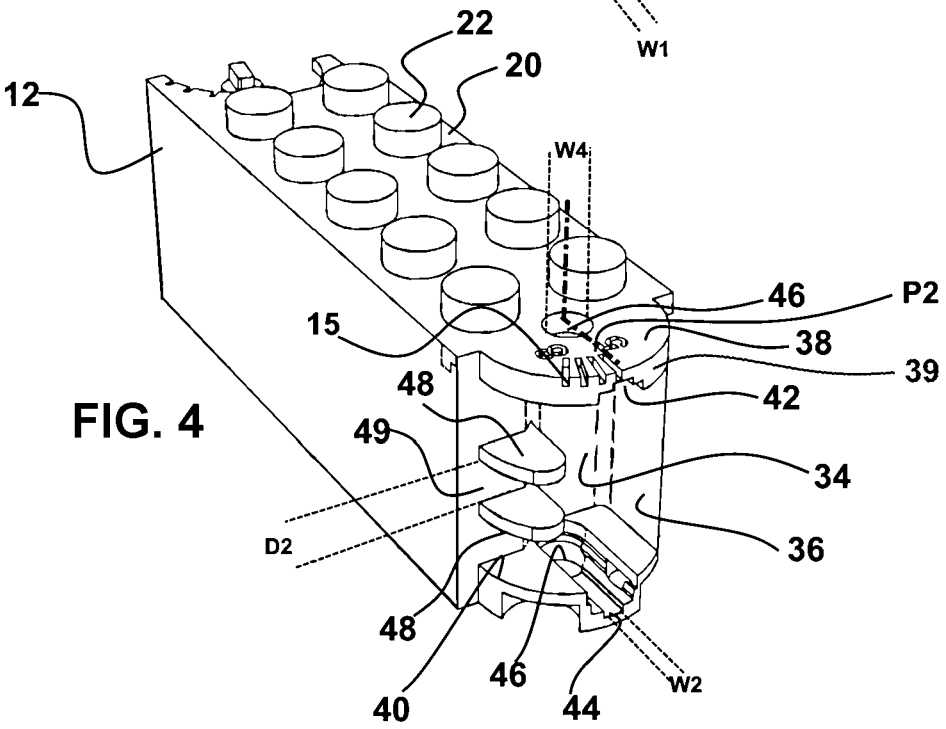
FIG. 4 shows the socket end of the rotational brick system herein which is adapted for pivoting or rotational engagement with the post end noted in FIG. 3.
Figure 5:
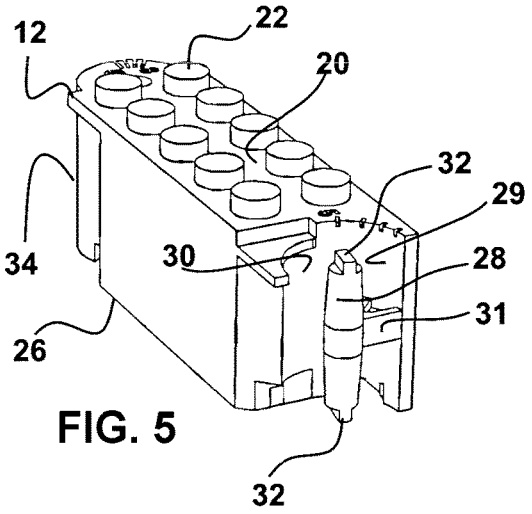
FIG. 5 shows another perspective view of the post end of the rotationally engageable bricks herein similar to that of FIG. 3.
Figure 6:
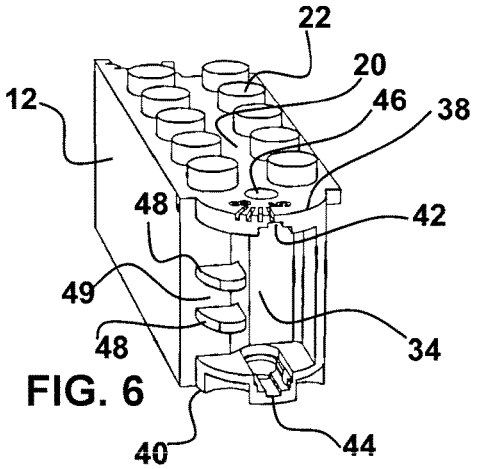
FIG. 6 depicts another perspective view of the socket end of the rotationally engageable bricks herein.

In FIG. 4 is depicted one preferred configuration of a second end, or the socket end, of the bricks 12 in all modes of the brick system 10 herein. As shown, a socket 34 adapted to removably rotationally engage the post 28 of an adjoining brick 12 is located on this second end. As can be seen in the drawings, the length of the bricks 12 may vary, as will the number of projections 22, but at the second end of the rotationally engageable bricks 12, there will be positioned a socket 34. This socket 34 is configured for removable rotationally engagement with the post 28 at a first end, or post end, of any adjacent positioned bricks 12.

In the modes of the bricks 12 of the system 10, as noted herein, the engagement and removal of this rotational engagement of the post 28 in a socket 34, is only achievable when the angle of the longitudinal axis X (FIG. 15) of two adjoining bricks 12, is at an engagement angle E (FIG. 15), which is shown and described in detail herein and may be either aligned with the longitudinal axis x of the brick 12 in some modes, or be substantially perpendicular thereto, depending on the configuration of the respective post and socket.

As shown, a recess 36 depends into the second end of the brick 12. This recess 36 is located between a first flange 38 extending adjacent or extending from the upper surface 20, and a second flange 40 extends away from the bottom 26. A first flange endwall 39 at the distal end of the first flange 38 extends toward the bottom 26.

A first slot 42 depends into one side of the first flange 38, and a second slot 44 depends into a side facing the first flange 38 on the second flange 40. Both the first slot 42 and second slot 44 run along a line aligned with or parallel with, the longitudinal or axis X (FIG. 14) of the brick 12 in one mode, and is perpendicular thereto in an alternative mode such as in FIGS. 15 and 26. In either mode, both slots 42, and 44, are aligned. Thus, the engagement angle would either be an alignment of the two respective longitudinal axis or positioning them substantially normal to each other.

Both slots 42 and 44 also intersect respective apertures 46 communicating through the first flange 38 and second flange 40. Both apertures 46 are axially aligned and have a width W4, defined by the diameter of the apertures 46. This aperture width or diameter W4 is preferably substantially equal to, or slightly larger, than a length W3 of the post projections 32 from end to end. This substantially equal or slightly larger length W3 allows the post projections 32 to rotate in an rotational contacting engagement within the inside wall of the apertures 46.

As shown, in all modes of the bricks 12 of the system 10 herein, the post projections 32 will only slide through the first and second slots 42 and 44, and into a rotating engagement within an aperture 46, when the two bricks 12 are at an engagement angle E, to each other. This engagement angle E can vary, but currently, a preferred range is between 60-90 degrees with the engagement angle E preferably being closer to 90 degrees such as shown in FIG. 15, because it allows for the most number of angles achievable by two engaged bricks 12 since once the two are rotated to any angle less than 90 degrees, they will not disengage.

Because this removable rotational engagement allows the post projections 32 to be slid along within the first slot 42 and second slot 44 and into the apertures 46, only when the two bricks 12 are at the engagement angle E, such as 90 degrees, one engaged and moved they are locked in the rotational engagement. This locked rotational engagement is maintained so long as the longitudinal axis of the two bricks 12 are at any angle relative to each, other less than or more than the engagement angle E. For example, if at an angle such as 50 degrees where the engagement angle E is 60 degrees or at an angle of 85 degrees where the engagement angle E is 90 degrees, the bricks 12 are maintained in a locked rotational engagement and cannot separate from the rotational engagement.

As shown, when in this rotational engagement such as shown in FIGS. 1-2, 9 and 16, the two adjacent removably rotationally engaged bricks 12, are held in the same plane by the automatic positioning of the mount 31 supporting the post 28, within the gap 49 (FIGS. 4 and 49 for example) into the sidewall and in-between formed guides 48. As shown, the gap 49 has a gap diameter D2, which is substantially equal to, or just slightly larger, than the width or diameter D1 of the mount 31 holding the post 28. This allows the upper and lower side edges of the mount 31 to slide in the gap 49 adjacent to or contacting the facing surfaces of the guides 48. During rotation of the rotationally engaged bricks 12, this engagement of the mount 31 between the guides 48, holds the two bricks 12 in the same plane during such a rotation.

In all modes of the system herein, the engagement of two bricks 12 preferably includes a pre-loading which imparts friction to prevent rotation without force being imparted to the bricks 12. This pre-loading forms a more secure engagement when building and is currently preferably accomplished by a slight reduction in the spacing distance P2 and P1 of the post 28 and socket center lines. For example, at least the first flange 38 may be formed sufficiently long that it contacts the wall defining the recess 30 on an engaged brick 12. This will impart a load or friction to rotation by the frictional contact of the edge of the first flange 38 against the wall of the recess 30. The pre-loading configuration may be included in any and all of the disclosed bricks 12 herein.

Alternatively or in combination, a frictional contact of the side of the post 28 against the interior sidewall surface of a mated aperture 46 can provide frictional resistance and pre loading. Thus, once engaged, the post 28 will impart friction against the sidewall of the aperture 46, and the sidewall of the flange 38 will frictionally contact against the wall of the recess 30, to allow for a forced movement by the user but maintain the angle of the two bricks 12 to each other. Still further, a pre-loading structure can be provided by the surfaces of the guides 48 facing the rotating post 28 which can be formed to contact against the post 28 and provide the pre-loading as a means for resistance to rotation.

In this pre-loading, the dimensions of the concave and convex ends of the bricks 12 establish the length of the brick pair. Reducing that spacing provides axial pre-load developed by contact of the first flange endwall 39 on the distal end of the flange 38, against the wall of the recess 30 which flexes the posts 28 similar to that of the bow of an archer. This pre-load force will develop resistance to axial bending, tensile torsion, and shear forces applied between the bricks. This pre-loading is preferred in all modes of the device 10, because it is desirable to stiffen the rotational engagement of rows formed of sequentially engaged bricks 12 or to stabilize hexagonal or other shaped rings of bricks. Additionally seen in the figures, and enlarged in FIGS. 1-3, for example, are the angle indicators 15. These angle indicators 15 are employable to accurately gauge the angular configuration between each of two adjoining bricks 12. Further, the angle indicators 15 are especially helpful when building interesting columns formed of aligned rings of five or more bricks 12 which can be made from stacking rings of bricks. These ring configurations can vary in size due to the number of bricks 12 and/or the length of the bricks 12. Using layer-to-layer spacers, these rings can be assembled to form twisted columns.

FIGS. 5-8 depicts various views of the bricks 12 shown above in FIGS. 1-4. These views provide a first end view and a second end view as well as perspective views of the various components of the bricks 12 herein Shown in FIG. 9 is a perspective view of a serpentine configuration of a wall formed of differently configured rotationally engaged bricks 12 herein. As can be seen, the bricks 12 can vary in length to provide more options to the builder. No matter the length, each brick 12 will have a recess 30 on one end with a post 28 engaged therein and upper flanges 38 and lower flanges 40 on the other end configured to rotationally engage with the post 28, once connected while in the engagement angle E. However, the bricks 12 can vary in length, number of projections 22, and forward and reverse configurations.

Each rotationally engaged brick 12 is freely pivoting by a slight force exerted by the user to rotate one or both bricks 12 to desired angles of the rotational engagement, to form the different angled portions of the completed wall. Angles of the differently configured engaged bricks 12 can require reverse configuration, or different engagement angles E, or longer or shorter bricks 12 as depicted in FIGS. 10-14, and other configurations.

FIGS. 10-14 show the varied size of the individual bricks 12 of those forming the wall in FIG. 9 and showing the differing lengths thereof. Also shown in FIG. 14 is a positioning of the first slot 42 and second slot 44 which are parallel to the center or longitudinal axis X of the brick 12. This configuration provides for engagement with a post 30 of an adjoining brick 12, which is positioned at an engagement angle E, to the axis X of the brick 12.

As shown in FIG. 15, particularly in the enlarged area views, the first slot 42 and second slot 44 both are formed in this mode to run perpendicular to the axis X of the brick 12. This configuration requires that the post projections 32 on the post 28 of an engaging brick 12, engage and slide along the first slot 42 and second slot 44 into the apertures 46, along a line running perpendicular to the axis X of the brick 12. This changes the engagement angle E where the two bricks 12 engage, an then later disengage. At all angles less than engagement angle E, such as any angle less than 90 degrees, the post projections 32 remain locked in rotational engagement within the apertures 46.

Also shown in FIG. 15 is an enlarged view of the post 28. As can be seen, the diameter of the post 28 tapers toward the opposing ends of the post 28. A central area 35 of the post 28, where it engages the mount 31, is slightly larger in diameter and circumference than the post 28 on either side thereof. In another or an additional mode of pre-loading the rotational engagement of bricks 12, the central area 35 can be formed with a diameter which causes the exterior surface of the post 28 at or adjacent the central area 35, to frictionally contact against one or both guides 48 or the edges thereof forming the gap 49.

FIG. 16 shows a series of bricks 12 configured as in FIG. 15, engaged sequentially. Also shown is a shortened brick from FIG. 18 which is rotationally engaged with the post 28 on the brick 12 at the straight end of the structure.

FIG. 17 depicts a shortened brick having the post 28 on one end adapted to engage along a first slot 42 and second slot 44 and into aligned apertures 46 of another of the bricks 12 herein.

FIG. 18 is similar in configuration to the brick of FIG. 17, but also includes the opening having aligned first and second slots 42 and 44, which allow for a sliding of the post projections 32 of a post 28 there along while in an engagement angle E, to rotationally engage within apertures 46 at the end of the two slots.

FIGS. 19-21 show a plurality of differently configured half-bricks 13 which are configured to engage to each other in a sequence such as shown in FIG. 23. In FIG. 19, the half-brick 13A is shown which has a slot 50 at one end adapted to engage with the post 28 such as shown on the half-brick 13B in FIG. 20 or the half-brick 13C as shown in FIG. 21. The half brick 13A shown in FIG. 19 has a first projection 52 extending away from the end opposite the end having the slot 50.

Shown in FIG. 20 is half-brick 13B which as noted is configured to engage an adjacent half brick slot 50 with a post 28 thereon. In a beam or strut or the like formed of the half-bricks in FIGS. 19-21, the half-brick 13B shown in FIG. 20, will generally be used to lengthen the formed structure by engaging more or less in between a first end of the formed strut at a half-brick 13A and a second end of the formed strut formed by half-brick 13C shown in FIG. 21.

As can be seen, the first projection 52 extends from the half-brick 13A of FIG. 19 and a second projection 54 extends from the end of half-brick 13C of FIG. 21, at an end opposite the post 28. Thus, an assembled strut or beam or other linear support structure formed by engaging half-bricks shown in FIG. 24, will have a first projection 52 at one end of the formed structure and a second projection 54 extending from the other end of the formed linear structure. The length of the formed structure such as in FIG. 24 can be adjusted by insertion of more or less of the centrally located half-bricks 13B of FIG. 20 or, of course, by using half-bricks which are shorter or longer in overall length.

Shown in FIG. 23 are the components to form a substantially rigid beam or strut 56 or the like as shown in FIG. 24. As can be discerned, a first elongated half strut is formed by a first plurality of half-bricks 13A, 13B, and 13C, and an elongated half strut is also formed in a mirror image of the first elongated half strut. Each of the half bricks has a pin 58 projecting therefrom and a cavity 60 adapted for frictional engagement of a pin 58 from a mating half-brick. As such, with two half struts formed, as in FIG. 23, they can be removably engaged in a rigid structure forming a strut 56, as in FIG. 24, by the engagement of the pins 58 on the half-bricks on one of the half struts with the cavities aligned therewith on the opposite second half strut. Once so engaged, a strong and rigid strut 56 is formed such as shown in FIG. 24.

Shown in FIG. 22 and in FIG. 24, are connector bricks 62. These connector bricks have a top surface having a plurality of projections 22 extending therefrom which will engage into the recess formed into the bottom surface 26 of all the other bricks 12 shown herein, and form a frictional contact against the wall 25 forming the curved or circular recesses 24 on such bricks 12 and on the sidewall 23 extending around the recess 27 in the bottom of the bricks 12 (FIG. 7-8 for example).

Figure 7:
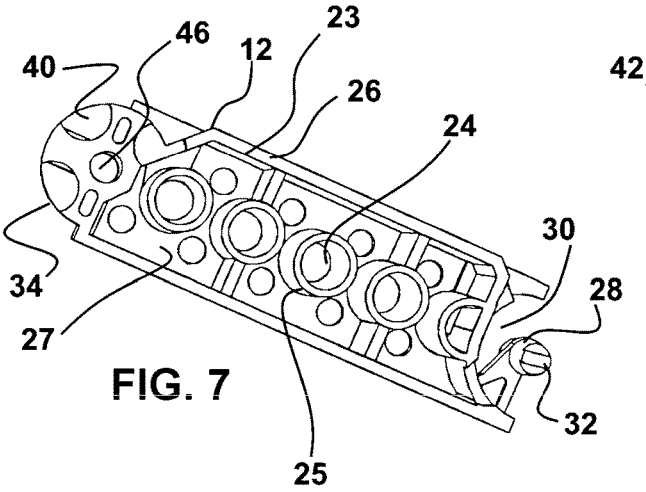
FIG. 7 shows a bottom perspective view of the device as depicted in FIG. 5.
Figure 8:
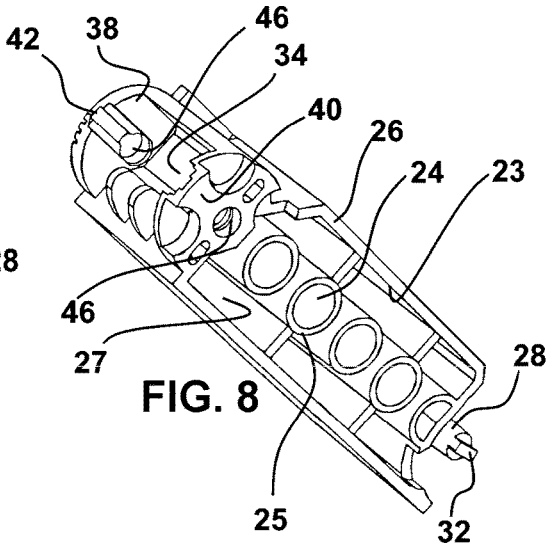
FIG. 8 shows a view of the device as in FIG. 7 at a differing perspective angle.

The bottom surface of the connector bricks 62 is similarly configured to that of the bricks 12 shown in FIGS. 7-8 which as noted is the bottom brick configuration of all the bricks 12 shown herein such as those of FIGS. 3-6 and FIGS. 15-16 and the depicted engagements thereof. Thus, it will easily engage the connector brick 62 with the projections 22 on the top surface 20 of any of the depicted bricks 12 or 13A-C herein.

The connector bricks 62 have a plurality of engagement slots 64 preferably formed in all of four sides of the connector bricks 62. These engagement slots 64 are configured to frictionally engage either of the first projection 52 or the second projection 54 of a formed strut 56 shown for example in FIG. 24. Thus, the connector bricks 62 provide for an engagement of the opposing ends of a formed strut 56 to a wall structure formed by the bricks 12 herein or in some instances with the projections 22 extending from an upper surface of a formed strut 56 shown in 56.

As noted, FIGS. 26-32 show views of another mode of the bricks 12 of the rotationally engageable brick system 10 herein. As with other bricks 12 herein, projections 22 extend from the top surface 20 and each brick 12 has an inside surface 70 and opposite outside surface 68, extend between the top surface 20 and the bottom 26 of each brick 12. The length of the brick 12 may vary and that varied length will also vary the number of projections 22 from the top surface 20.

As shown in various views of FIGS. 26-32, the gap 49 into which the mount 31 of the post 28 rotates and engages, is defined by the gap 49 formed in a sidewall 66 which is shown as an elongated configuration of the first flange endwall 39 in other drawings. The elongated sidewall 66 surrounds preferably at least half of the socket 34 into which the post 28 of an adjoining brick 12 is rotationally engaged. This sidewall 66 extends between the top surface 20 and the bottom 26 of the brick 12. This curved sidewall 66 is preferred because it fills and forms a gapless exterior or viewed exterior surfaces 68 of the side of a row of bricks 12 formed by a plurality of engaged bricks 12.

This gapless engaged configuration is provided whether or not longitudinal axis X of both adjoining bricks 12 are aligned or at an acute or obtuse angle to each other, when the structure of sequentially engaged bricks 12 is viewed from the outside surface 68 side of all the sequentially engaged bricks 12, such as shown in FIG. 32. This is because, by design, each sidewall 66 fills any space between the two ends of adjacent bricks 12. Such is most important to model builders and the like, to achieve a clean, uninterrupted exterior surface to the structure they build which stacked rows of engaged bricks 12.

The act of operatively engaging any two adjacent bricks 12 herein, to yield this gapless configuration of the rows and structure, is shown for example in FIG. 31. Once so engaged, the space between any two bricks 12 in a row or sequential engagement, will have spaces between adjacent bricks filled with the sidewall 66 which will cover substantially all of the area of any space between the outside surfaces 68 of adjacent bricks 12 with the surface of the sidewall 66. This yields a similar view to that of FIG. 9, which also accomplishes the preferred gapless engagement of adjacent bricks 12, when viewed from the outside surface 68 or viewed side of the engaged bricks 12 forming a structure.

Another preferred mode of the brick 12 in the system herein, is shown in FIGS. 33-35 which depict a mode of the rotationally engageable bricks 12 herein, having a curved outside surface 68. Such allows for the formation of stacked rows of sequentially engaged bricks 12 to create curved structures such as shown in FIGS. 68-69. As can be seen, the outside surface 68 of each brick 12 is curved and runs between the first end and second end of each brick 12. As shown, the outside surface 68 is located between the curved first side edge 21 and the curved second side edge 33. This results in a curved outside surface 68 which is longer in length between the first and second end of the brick 12 than the length of the inside surface 70.

FIGS. 68-69 show bricks with this curved outside surface 68 engaged to form a circular row of bricks 12. Other rows in this configuration may be stacked upon the lower rows, allowing the user to form curved or circular tower structures and the like, with spaces in between the engaged bricks 12 filled by the sidewall 66 to provide a gapless view of the formed rows and structures.

In FIGS. 36-38 is shown bricks 12 with a similar curved configuration of the outside surface 68 of the bricks 12. In the modes of the bricks 12 with a curved outside surface 68, the first side edge 21 runs in an arc or curved line substantially parallel to the second side edge 33 at the bottom 26. In this mode, the outside surface 68, in between the first side edge 21 and the lower second side edge 33, slants or angles in a direction away from or outward from the intersection with the top 20 of the brick 12 to the intersection of the outside surface forming the sidewall 68 with the bottom 26 of the brick 12. Thus, the sidewall 68 angles outward from the first side edge 21 outward to the second side edge 33. By angles outward is meant that the center of the second side edge 33 adjacent the bottom surface 26 is a distance further from the axis X (see FIG. 3) of the brick 12 than the center of the first side edge 21 at the upper surface 20

For these curved bricks 12, the top radii always matched a brick 12 that has one projection 22 pair, and the bottom radii always matched a brick 12 that has one projection 22 pair length more. This allows the bricks 12 with this curved outside surface 68 to stack easily together while also providing a smooth transition of the slanted curved outside surface 68 along the plurality of stacked bricks 12, as shown in FIG. 71.

Thus, the depicted bricks 12 of FIGS. 36-38, with the depicted curved and outward-angled outside surfaces 68, may be engaged to form circular and curved walls for toy structures such as in FIGS. 68-69. Additionally when engaged, as in FIG. 70, and stacked on top of each other, and the projections 22 engaged with mating surfaces, the inside surface 70 will overhang that of the brick below and the angled outside surfaces 68, can form slanted or ramped structure such as in FIG. 71.

FIGS. 39-42 show a mode of the brick 12 herein, configured for an inverted angle of the outside surface 68 of each brick. In this and similar inverted configurations, the outside surface is longer than the inside surface 70 since it curves, and it angles outward toward the wider top surface 20 from its intersection with the narrower bottom 26 of the brick 12. Thus, sequentially engaged bricks 12 can form walls and structures having a narrower base on which the bottom of the engaged bricks 12 to a wider top.

FIGS. 43-47 show another mode of the brick 12 in a similar configuration to that of FIGS. 39-42. As shown, each brick 12 has a curved outside surface 68, which also angles outward from its intersection with the bottom 26 of the brick 12. This outside surface angles outward and upward to an intersection of the outside surface with the top surface 20 of the brick 12. All employ the same rotational engagement and sidewall 66 to fill any gaps between adjacent bricks 12.

Depicted in FIGS. 48-52, are views of a brick 12 of the system herein, configured for a terminating engagement between curved walls formed by sequentially engaged bricks 12 having curved outside surfaces 68, such as shown in FIGS. 68-69. Because of the curved engagement of the string or row of sequentially engaged bricks 12, engaging a post 28 into slots 42 and 44 can be challenging. Because the post 28 has been removed from the mount 31 on the last brick 12, this brick 12 can be pivoted into place without regard to the local rotational angle of the last brick 12 in the sequence. A temporary increase in the recess 30 is necessary to pivot the last brick 12 into place. The tapered mount 31 that provides pre-load between the last of the sequentially engaged bricks 12 are formed of material that is flexible and a suitable gap or recess 30 can be developed with spreading with your fingers for rings with several connections and longer bricks 12. This limit can be established once plastic properties are established. Smaller diameter rings formed of sequentially engaged bricks 12 will require two post-less bricks 12 located at the end of the "C" shaped group of sequentially engaged brick half rings. The two half rings can be slid together and the full ring installed vertically.

In such instances in the brick system herein, the bricks 12 of FIGS. 48-52 and similar curved bricks 12 herein, may employ an engagement of the post 31 into the notch 48 to initially hold the curved or circular configuration. Thereafter, if another circular row of bricks 12 is stacked thereupon, the engagements of the projections 22 of the lower-positioned bricks 12, with the mating bottom 26 of the overhead positioned bricks 12, will serve to also secure both from moving apart or changing the shape of the formed wall or row.

FIGS. 53-57 depicts a mode of the brick 12 which can be formed and employed with the system herein. As shown, the curved bricks 12 with curved outside surfaces 68 opposite shorter inside surfaces 70, are shorter than those shown in FIGS. 33-35. This shows that the bricks 12 in such a curved configuration may be formed in virtually any length, and the number of projections 22 will vary accordingly. Also varying will be the mating surfaces on the bottom of bricks 12 engaged to the top surface 20, as they will be configured to align with and operatively mate to the underlying projections 22.

This ability to vary the length of the rotationally engaging bricks 12 herein, is also shown in FIGS. 58-62. As depicted, the bricks 12 are similar in structure and function to those of FIGS. 36-38 and have outward slanting outside surfaces 68 formed in the same fashion.

This configuration of the bricks 12 of the system herein to rotationally engage any length brick 12 having a post 28 at one end and the receiving cavity at the opposite end, is also shown in FIGS. 63-67. As shown the bricks in FIGS. 63-67 having an overall length between the first and second ends which is longer than that of FIGS. 58-62 but is shorter than that of FIGS. 36-38. However, any of the differing length bricks will operatively connect to the others, no matter the length. Thus, users may employ the curved bricks 12 of differing lengths with each other, to form curved or curvilineal structures. The curved bricks 12 will also operatively engage with any linear configured brick herein as all have the same post 28 configured first end engageable with a socket on a second end.

As noted above, FIG. 68, shows a circular configuration being formed of bricks 12 such as those of FIGS. 53-57 and having a terminating brick such as in FIGS. 48-52, positioned on one end of the sequentially engaged bricks 12. This terminating brick as shown in FIG. 69 uses the T shaped mount 31 for a connection with the notch 49 in the sidewall 66 of the first brick 12 in the circularly engaged sequence. As shown are a circular structure formed of 8, 30° bricks 12 to form circles, octagons, flared in or flared out, etc. These bricks 12 could be made from five sides to many sides.

As also noted above, FIG. 70 shows two adjoining bricks 12 configured similar to those of FIGS. 63-67. They are sequentially engaged to form an a curved outside surface 68 which also slants away from the top surface 20 of the engaged bricks 12.

In FIG. 71 the ability of the outward slanted or convergent style bricks 12 such as those in FIG. 63-67, to form a stacked structure is shown. As depicted, the bottom exterior edge of each brick 12 stacked upon a lower brick 12 is substantially flush and aligned with the top edge of the exterior surface 68 of the lower positioned brick 12. This stacked row positioning can be continued to form pyramidic and other structures with sloping exterior walls.

The links shown in FIGS. 35 through 71 are all 45° arc sectors requiring eight bricks to form to form a full ring. The pegs on the top surface form an octagon and octagons comprised of bricks shown in FIGS. 1-32 are compatible for staking on either side of the circular ring It should be noted that any of the different depicted and described configurations and components of the toy brick system 10 herein, can be employed with any other configuration or component shown and described as part of the device herein. Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A toy brick system comprising:

a plurality of bricks each having a body;

each said body running along a longitudinal axis between a first end of said body and a second end of said body;

each said body having a top surface opposite a bottom;

each said brick having a plurality of projections extending above said top surface;

each said brick having a recess depending into said bottom;

each said brick having an outside surface extending between a first side edge running on one side of said top surface and a second side edge running on one side of said bottom;

each said brick having an inside surface opposite said outside surface;

each said brick having a mount extending from said first end of said body to a central area of a post, said post extending from said mount in a first direction to a first end of said post, said post extending from said mount in a second direction opposite said first direction to a second end of said post, said post running along a post axis between said first end thereof and said second end thereof;

said post axis running substantially normal to said longitudinal axis;

said post axis running substantially normal to a plane of said top surface;

a recess positioned between a first curved sidewall positioned at said first end of said body and said post;

each said brick having a socket positioned at said second end of said body in between a first surface of a first flange at said second end of said body, and a first surface of a second flange extending from said second end of said body;

a socket sidewall extending between said first flange and said second flange;

a first elongated slot formed into said first surface of said first flange;

a second elongated slot formed into said first surface of said second flange, said second slot being aligned with and facing said first slot;

said post at said first end of said body of a first brick of said plurality of bricks, positionable to a rotational engagement with a said socket of a second brick from said plurality of bricks by sliding said post into said socket while said first end of said post is positioned within said first elongated slot and said second end of said post is located within said second elongated slot;

said first curved sidewall on said first brick while in said rotational engagement, being coaxial to said socket sidewall of said second brick;

said socket sidewall positioned within a gap between said first brick and said second brick while in said rotational engagement; and said plurality of bricks in said rotational engagement being pivotable in a common plane, whereby they are pivotable in respective said rotational engagements to form curved structures.

2. The toy brick of claim 1, additionally comprising:
said outside surface following a curve in between said first end of said body and said second end of said body; and
said inside surface being planar.

3. The toy brick of claim 2, additionally comprising:
a gap formed into said socket sidewall; and
said mount positioned to a mount engagement within said gap in said socket sidewall in said rotational engagement.

4. The toy brick of claim 3, additionally comprising:
said second side edge running substantially parallel to said first side edge;
said outside surface extending in an angle from said first side edge positioned closest to said longitudinal axis, to said second side edge positioned a distance further from said longitudinal axis than said first side edge.

5. The toy brick of claim 3, additionally comprising:
said socket sidewall covering said gap between said first brick and said second brick while in said rotational engagement.

6. The toy brick of claim 2, additionally comprising:
said second side edge running substantially parallel to said first side edge;
said outside surface extending in an angle from said first side edge positioned closest to said longitudinal axis, to said second side edge positioned a distance further from said longitudinal axis than said first side edge.

7. The toy brick of claim 1, additionally comprising:
a gap formed into said socket sidewall; and
said mount positioned to a mount engagement within said gap in said socket sidewall within said rotational engagement.

8. The toy brick of claim 7, additionally comprising:
said second side edge running substantially parallel to said first side edge;
said outside surface extending in an angle from said first side edge positioned closest to said longitudinal axis, to said second side edge positioned a distance further from said longitudinal axis than said first side edge.

9. The toy brick of claim 8, additionally comprising:
said socket sidewall covering said gap between said first brick and said second brick while in said rotational engagement.

10. The toy brick of claim 1, additionally comprising:
said socket sidewall covering said gap between said first brick and said second brick while in said rotational engagement at multiple angles of alignment between said longitudinal axis of said first brick and said longitudinal axis of said second brick.

* * * * *